US011345152B2

(12) United States Patent
Takahashi et al.

(10) Patent No.: US 11,345,152 B2
(45) Date of Patent: May 31, 2022

(54) PRINTING APPARATUS AND CARRIAGE

(71) Applicant: SEIKO EPSON CORPORATION, Tokyo (JP)

(72) Inventors: Yoji Takahashi, Matsumoto (JP); Osamu Murayama, Yamagata-mura (JP); Daiki Tatsuta, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/143,406

(22) Filed: Jan. 7, 2021

(65) Prior Publication Data

US 2021/0213736 A1 Jul. 15, 2021

(30) Foreign Application Priority Data

Jan. 10, 2020 (JP) ..... JP2020-002659

(51) Int. Cl.
*B41J 2/145* (2006.01)
*B41J 2/175* (2006.01)
*B41J 29/393* (2006.01)

(52) U.S. Cl.
CPC ..... *B41J 2/145* (2013.01); *B41J 2/175* (2013.01); *B41J 29/393* (2013.01)

(58) Field of Classification Search
CPC ..... B41J 2/1752; B41J 2/17553; B41J 2/175; B41J 29/02; B41J 2/145; B41J 29/393; B41J 2202/19
See application file for complete search history.

(56) References Cited

U.S. PATENT DOCUMENTS 10,668,735 B2 * 6/2020 Tomoguchi ..... B41J 2/1753
2011/0205284 A1 * 8/2011 Yoshino ..... B41J 2/17509 347/85
2015/0077484 A1 * 3/2015 Nagashima ..... B41J 2/1752 347/86

FOREIGN PATENT DOCUMENTS

JP 2018-122535 A 8/2018

* cited by examiner

*Primary Examiner* — An H Do
(74) *Attorney, Agent, or Firm* — Workman Nydegger

(57) ABSTRACT

A printing apparatus includes a head unit having a support portion configured to support a plurality of heads capable of discharging a droplet in a discharge direction, and a carriage on which the head unit is removably mounted from upstream in the discharge direction, wherein the carriage has a bottom formed with an opening from which a nozzle surface of the head for discharging the droplet is exposed, the support portion is provided with at least one protruding portion protruding from a bottom surface of the support portion in the discharge direction, and the bottom is provided with an insertion hole through which the at least one protruding portion is inserted, and a biasing member biasing the support portion in an intersecting direction intersecting with the discharge direction in a state where the at least one protruding portion is inserted through the insertion hole.

11 Claims, 19 Drawing Sheets

PRINTING APPARATUS AND CARRIAGE

The present application is based on, and claims priority from JP Application Serial Number 2020-002659, filed Jan. 10, 2020, the disclosure of which is hereby incorporated by reference herein in its entirety.

BACKGROUND

1. Technical Field

The present disclosure relates to a printing apparatus and a carriage.

2. Related Art

In the past, a printing apparatus has been known that includes a head capable of discharging droplets toward a medium, and a carriage mounted with the head and reciprocating in a width direction of the medium, and in which the head mounted on the carriage can be replaced. For example, JP 2018-122535 A discloses a printing apparatus including a plate portion to which a head is attached, and a carriage to which the plate portion is detachably attached, and a positioning pin provided at the plate portion is engaged with a positioning groove provided at the carriage to perform head replacement. In the printing apparatus, the head is attached and detached from below, which is downstream in a discharge direction, to and from an opening portion provided in the plate portion.

A head unit constituted by a plurality of heads corresponding to a plurality of types of colors is mounted on the carriage. In addition, a configuration in which the head can be easily replaced by a user is desired for the printing apparatus. However, since the head unit is increased in weight and size, in the configuration in which the head unit is attached and detached from below, as in JP 2018-122535 A, an operation of attaching the head unit to the carriage and precisely positioning is complicated, and it was a difficult operation for the user itself to replace the head.

SUMMARY

A printing apparatus includes a head unit having a support portion configured to support a plurality of heads capable of discharging a droplet in a discharge direction, and a carriage on which the head unit is removably mounted from upstream in the discharge direction, wherein the carriage has a bottom formed with an opening from which a nozzle surface of the head for discharging the droplet is exposed, the support portion is provided with at least one protruding portion protruding from a bottom surface of the support portion in the discharge direction, and the bottom is provided with an insertion hole through which the at least one protruding portion is inserted, and a biasing member biasing the support portion in an intersecting direction intersecting with the discharge direction in a state where the at least one protruding portion is inserted through the insertion hole.

A carriage is a carriage on which a head unit is removably mounted from upstream in a discharge direction, the head unit including a support portion supporting a plurality of heads capable of discharging a droplet in the discharge direction, and at least one protruding portion protruding downstream in the discharge direction from a bottom surface of the support portion, the carriage including a bottom formed with an opening from which a nozzle surface of the head for discharging the droplet is exposed, wherein the bottom is provided with an insertion hole through which the at least one protruding portion is inserted, and a biasing member biasing the support portion in an intersecting direction intersecting with the discharge direction in a state where the at least one protruding portion is inserted through the insertion hole.

DESCRIPTION OF EXEMPLARY EMBODIMENTS

1. Exemplary Embodiment 1

1-1. Schematic Configuration of Printing Apparatus

Figure 1:
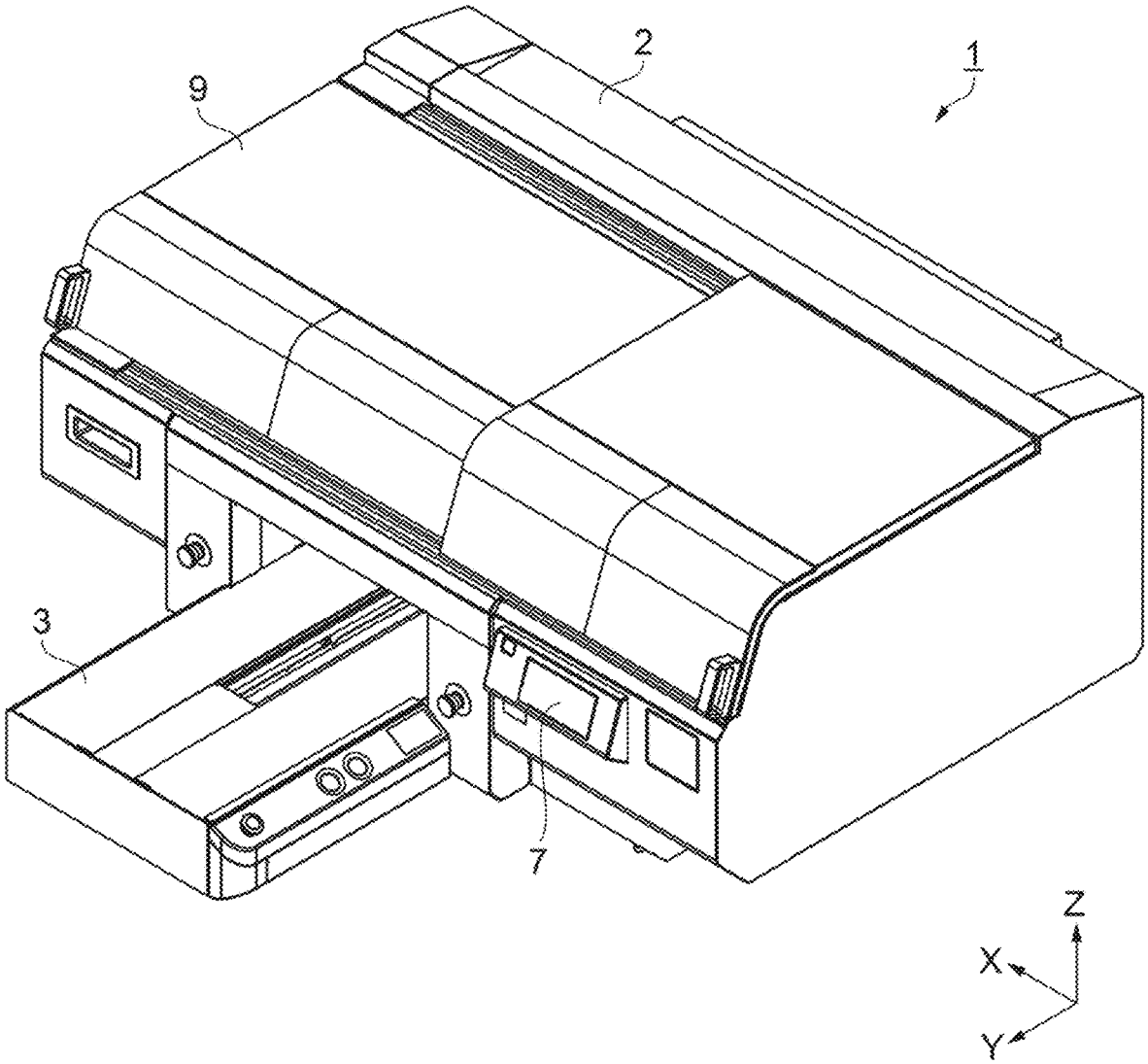
FIG. 1 is a perspective view illustrating a configuration of a printing apparatus according to Exemplary Embodiment 1.

A schematic configuration of a printing apparatus 1 according to Exemplary Embodiment 1 will be described with reference to the drawings. Note that, in coordinates indicated in the drawings, both directions along a Z-axis are up-down directions and an arrow direction is "up", both directions along an X-axis are left-right directions and an arrow direction is "left", and both directions along a Y-axis are front-back directions and an arrow direction is "front". In addition, a main scanning direction corresponds to the left-right direction, and a sub scanning direction corresponds to the front-back direction. In addition, in both the directions along the Z-axis, the arrow direction is "positive", in both the directions along the-X axis, the arrow direction is "positive", and in both the directions along the Y-axis, the arrow direction is "positive".

The printing apparatus 1 is an ink-jet type printer for discharging droplets on a medium supported by a medium support portion 3 with a lower side along the Z-axis (−Z direction) as a discharge direction, to print a desired image. The printing performed by the printing apparatus 1 is performed, for example, based on image data received from an external device such as a personal computer or a digital camera coupled to the printing apparatus 1. A variety of materials can be used as the medium, such as, for example, fiber that is a material for T-shirts, paper, and vinyl chloride resin.

Figure 2:
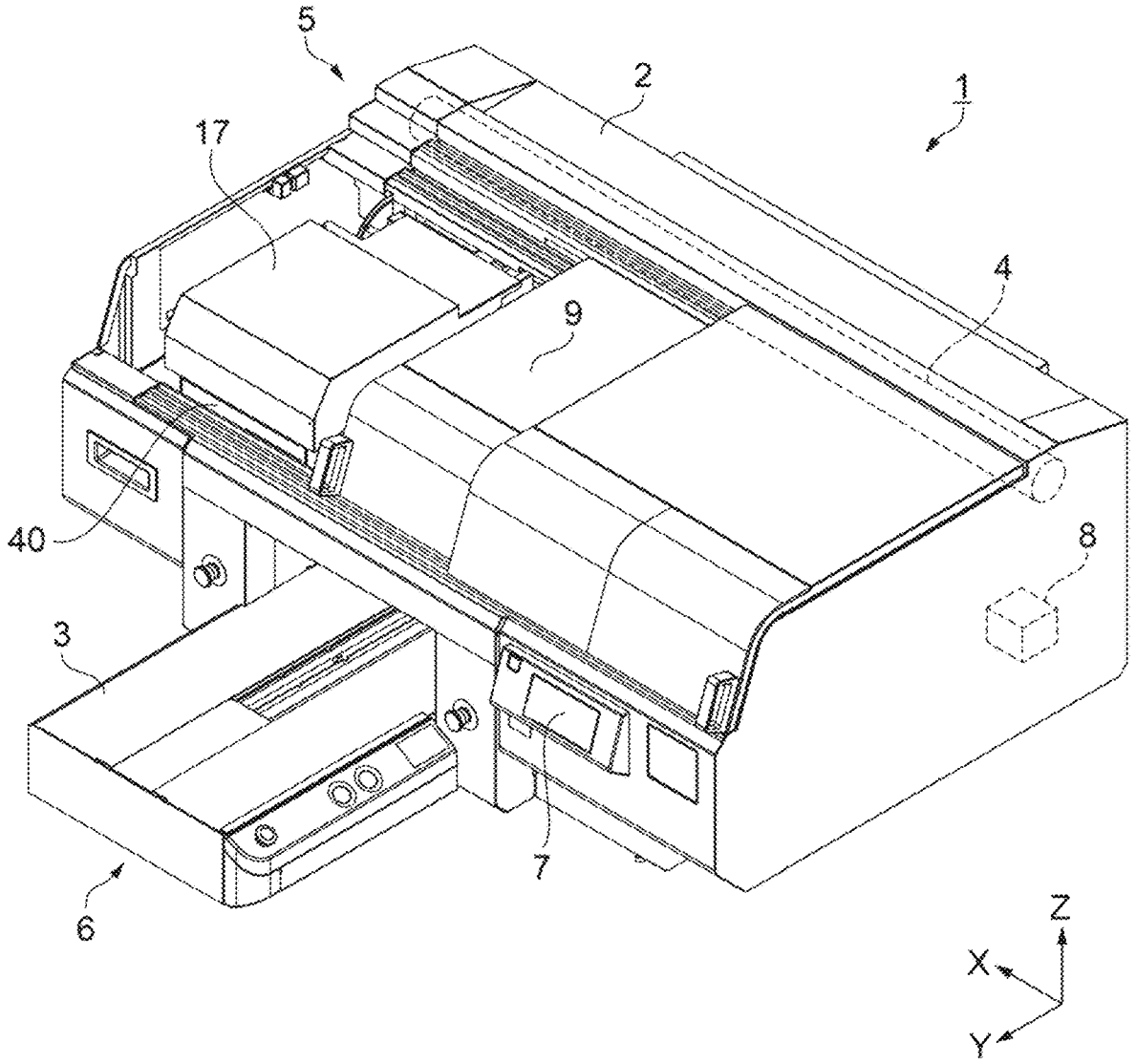
FIG. 2 is a perspective view illustrating the printing apparatus with a lid open.
Figure 3:
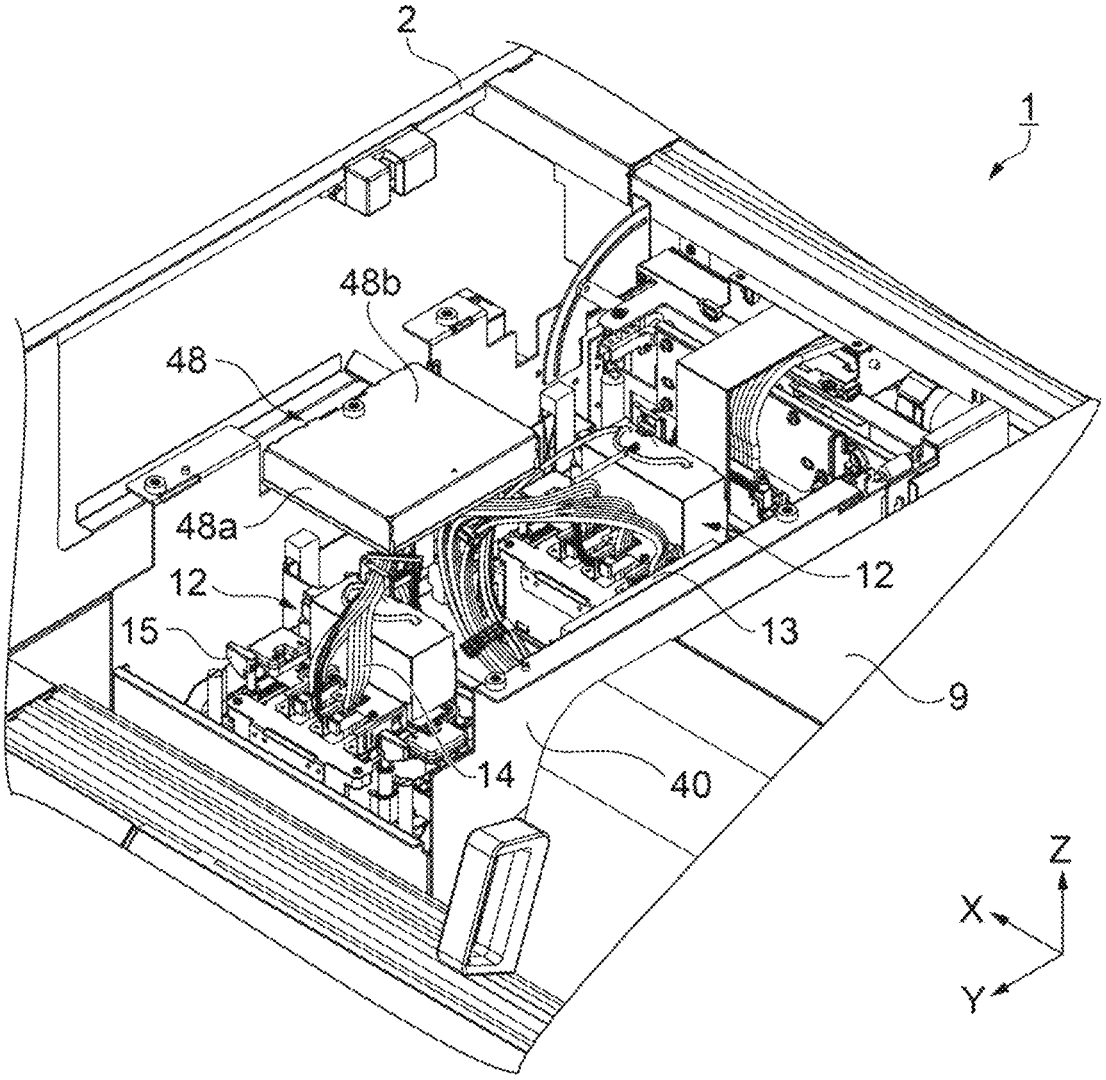
FIG. 3 is a perspective view illustrating a configuration around a carriage.

As illustrated in FIGS. 1 to 4, the printing apparatus 1 includes a housing 2 and a lid 9 that covers an inside of the housing 2 in an openable and closable manner. The printing apparatus 1 includes the medium support portion 3 supporting the medium, a head unit 20 including a plurality of heads 30 capable of discharging droplets onto the medium, a liquid supply unit 12 supplying liquid to the head 30, and a carriage 40 on which the head unit 20 and the liquid supply unit 12 are mounted. Further, the printing apparatus 1 includes a guide rail 4 extending in the main scanning direction and fixed to the housing 2. The carriage 40 is slidably supported along the guide rail 4. As illustrated in FIG. 3, the carriage 40 includes two number of the liquid supply units 12 arranged in the front-back direction. In other words, the printing apparatus 1 according to the present exemplary embodiment includes two number of the head units 20. A configuration of the head 30 and head unit 20 will be described in detail below.

As illustrated in FIG. 2, the printing apparatus 1 includes a main scanning unit 5 reciprocating the head unit 20 in the main scanning direction, a sub scanning unit 6 reciprocating the medium support portion 3 in the sub scanning direction, and the like. Note that, FIG. 2 illustrates the printing apparatus 1 with the lid 9 of a slide type open. The printing apparatus 1 of the present exemplary embodiment includes a carriage cover 17 covering the carriage 40 on which the head unit 20 and the liquid supply unit 12 are mounted. The carriage cover 17 is removably provided at the carriage 40 by a plurality of screws.

The main scanning unit 5 performs a main scanning for moving at least one of the head unit 20 and the medium support portion 3 such that respective relative positions of the head unit 20 and the medium support portion 3 change in the main scanning direction. The main scanning unit 5 includes a motor or the like as a drive source when reciprocating the carriage 40 in the left-right direction, which is the main scanning direction, along the guide rail 4. Based on control by a control unit 8, the main scanning unit 5 moves the carriage 40 on which the head unit 20 is mounted in the left-right direction. In other words, in the printing apparatus 1, the head unit 20 moves in the main scanning direction with respect to the medium support portion 3.

The sub scanning unit 6 performs a sub scanning for moving at least one of the head unit 20 and the medium support portion 3 such that respective relative positions of the head unit 20 and the medium support portion 3 change in the sub scanning direction. The sub scanning unit 6 includes a transport rail extending in the sub scanning direction, and a motor as a drive source when moving the medium support portion 3 in the sub scanning direction along the transport rail. The sub scanning unit 6, based on the control by the control unit 8, moves the medium support portion 3 in the front-back direction, which is the sub scanning direction. In other words, in the printing apparatus 1, the medium support portion 3 moves in the sub scanning direction with respect to the head unit 20.

An operation unit 7 for operating the printing apparatus 1 is provided at a front face of the housing 2, and the control unit 8 for control overall operation of the printing apparatus 1, and the like are provided inside the housing 2. The operation unit 7 is a touch panel including a display unit and an input unit as a human interface, with which instruction for the control unit 8, display of information necessary for operation of the printing apparatus 1, and the like are performed.

Based on the control by the control unit 8, the printing apparatus 1, while causing droplets to be discharged from the head 30, alternately repeats the main scanning for moving the carriage 40 in the main scanning direction, and the sub scanning for moving the medium support portion 3 in the sub scanning direction, to print images or characters on the medium.

1-2. Configuration of Head Unit and Carriage

As illustrated in FIG. 3, the printing apparatus 1 includes the liquid supply unit 12 coupled to the head unit 20, and supplying liquid to the plurality of heads 30. The liquid supply unit 12 communicates with a liquid supply source such as an ink tank or an ink pack by a tube 14, and liquid is supplied from the liquid supply source via a filter 13. The filter 13 acquires air bubbles and foreign materials in the liquid and is replaceably provided at a right side wall of the carriage 40. That is, the liquid supply source is coupled to the filter 13 via a tube (not illustrated) that is different from the tube 14. Then, the filter 13 is coupled to the liquid supply unit 12 via the tube 14.

Figure 4:
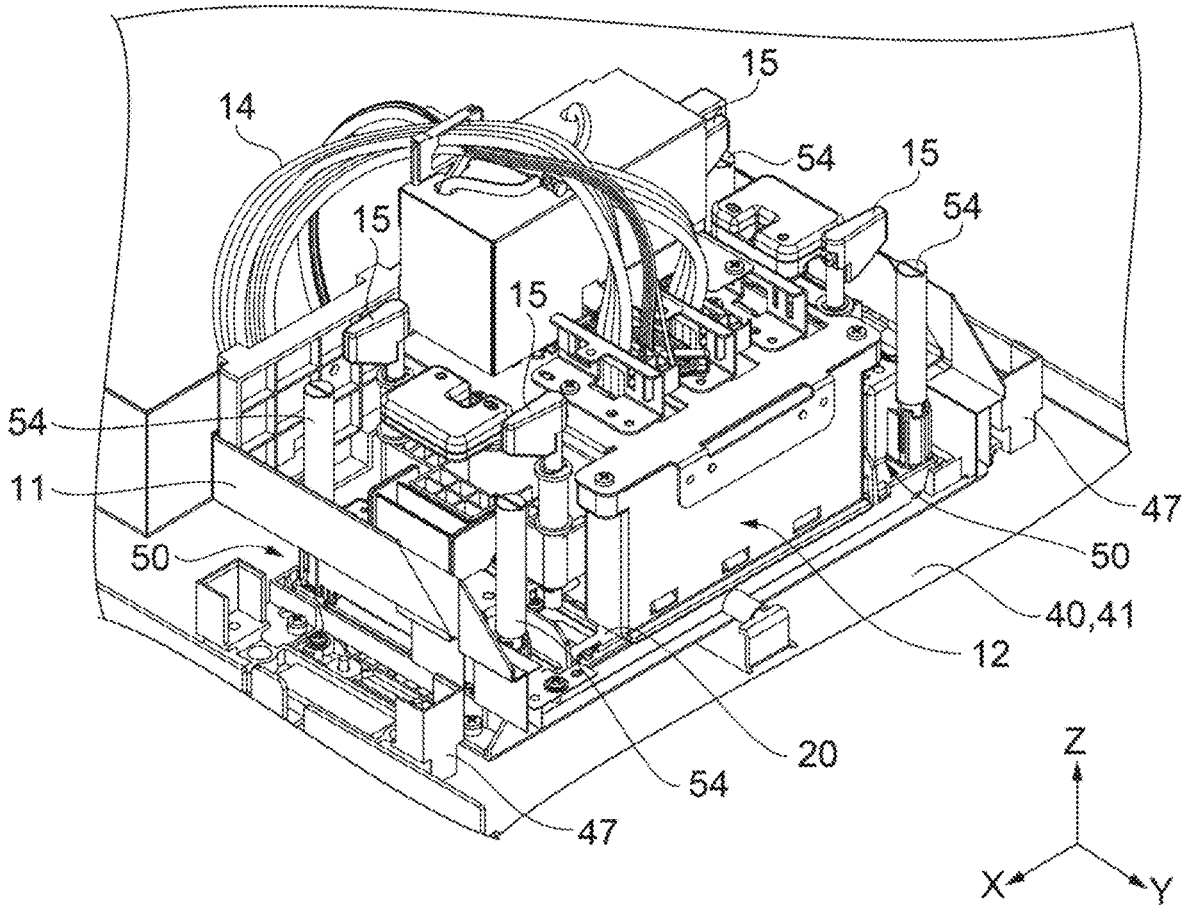
FIG. 4 is an enlarged perspective view illustrating a configuration inside the carriage.
Figure 5:
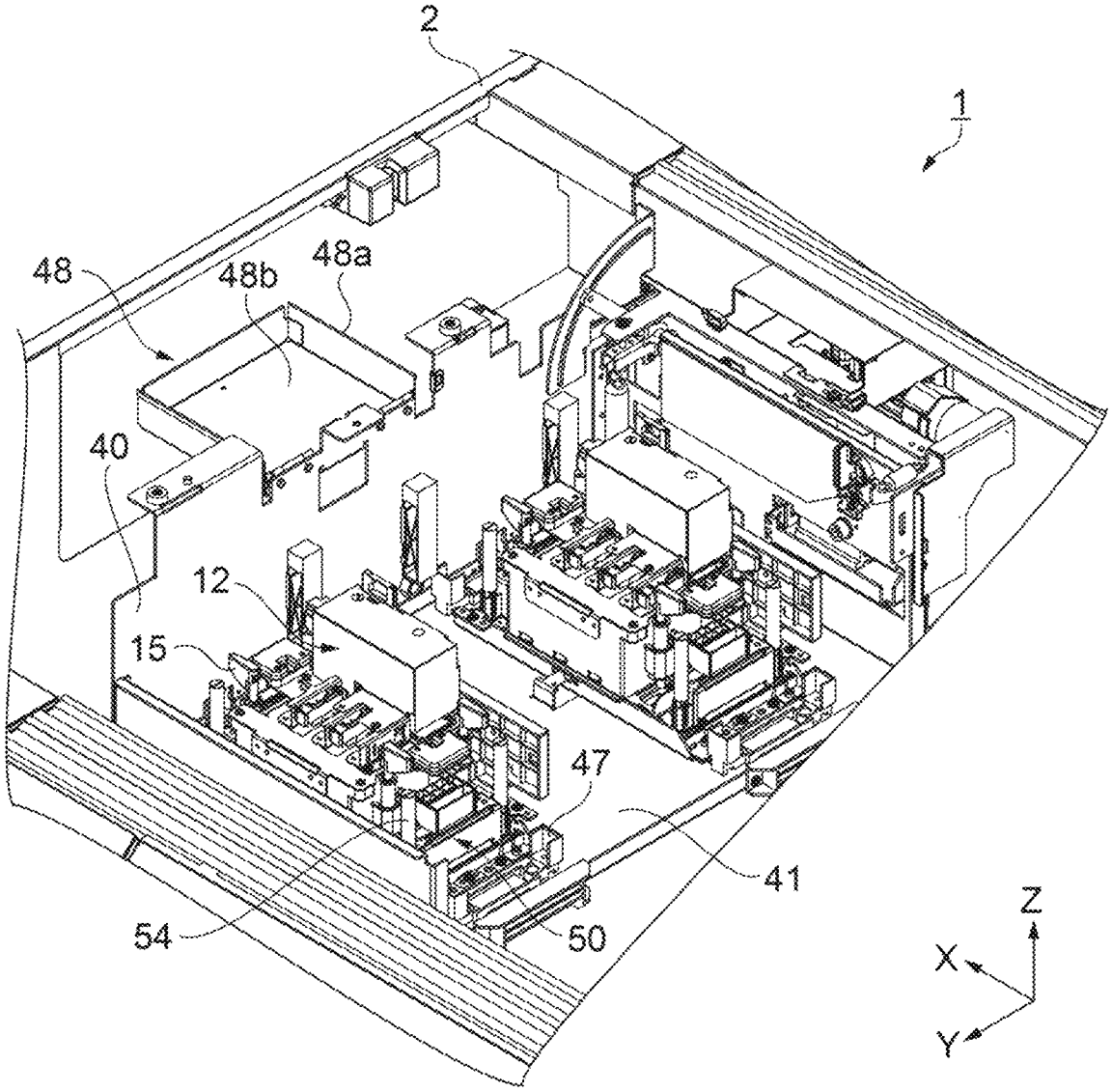
FIG. 5 is a perspective view illustrating a carriage periphery with a supply unit placement portion unfolded.

As illustrated in FIGS. 3 to 5, the carriage 40 has a box shape with an upper side open. In FIGS. 4 and 5, for convenience of explanation, illustration of a part or all of side walls of the carriage 40 is omitted. The carriage 40 supports the head unit 20 from below, and the head unit 20 supports the liquid supply unit 12 from below. That is, the head unit 20 and the liquid supply unit 12 are configured to be removable from an upper side that is upstream in the discharge direction with respect to the carriage 40.

Figure 6:
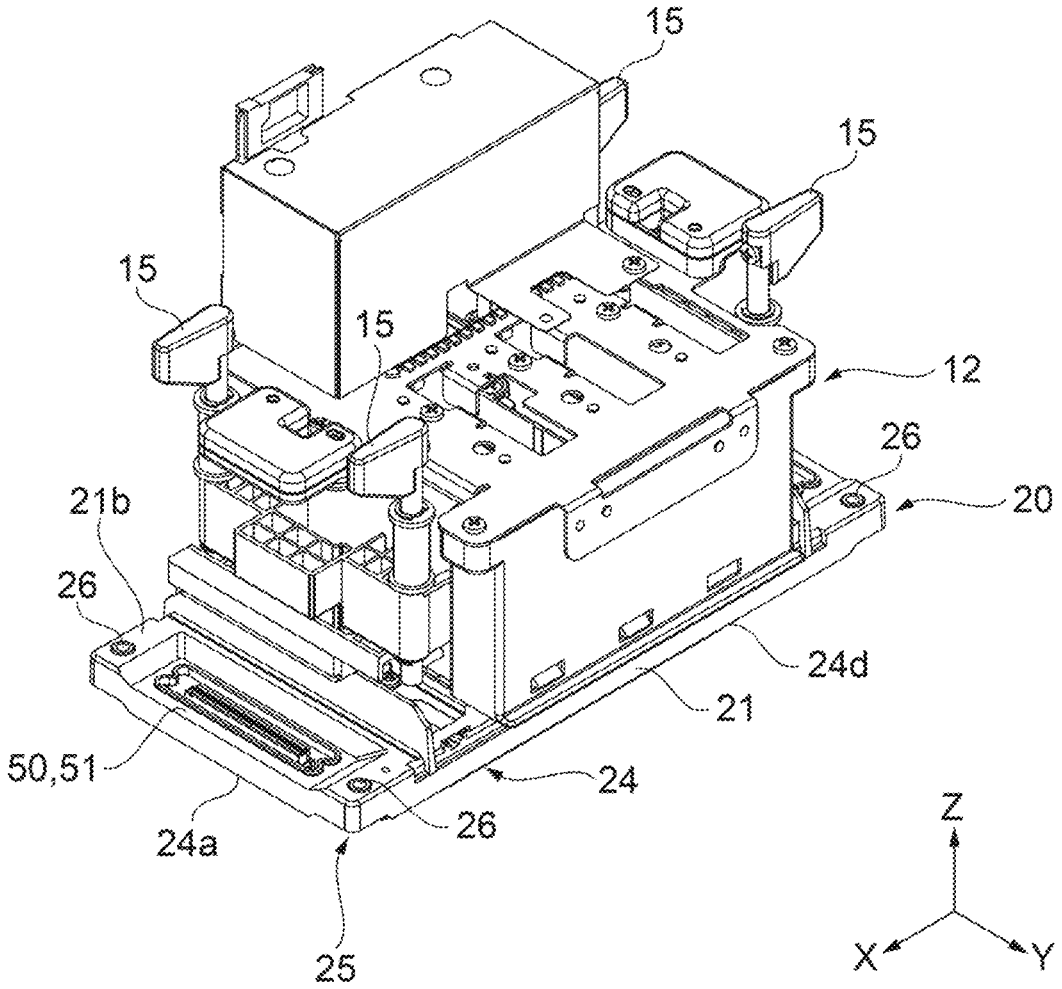
FIG. 6 is a perspective view illustrating a state where a liquid supply unit is mounted on a head unit.
Figure 7:
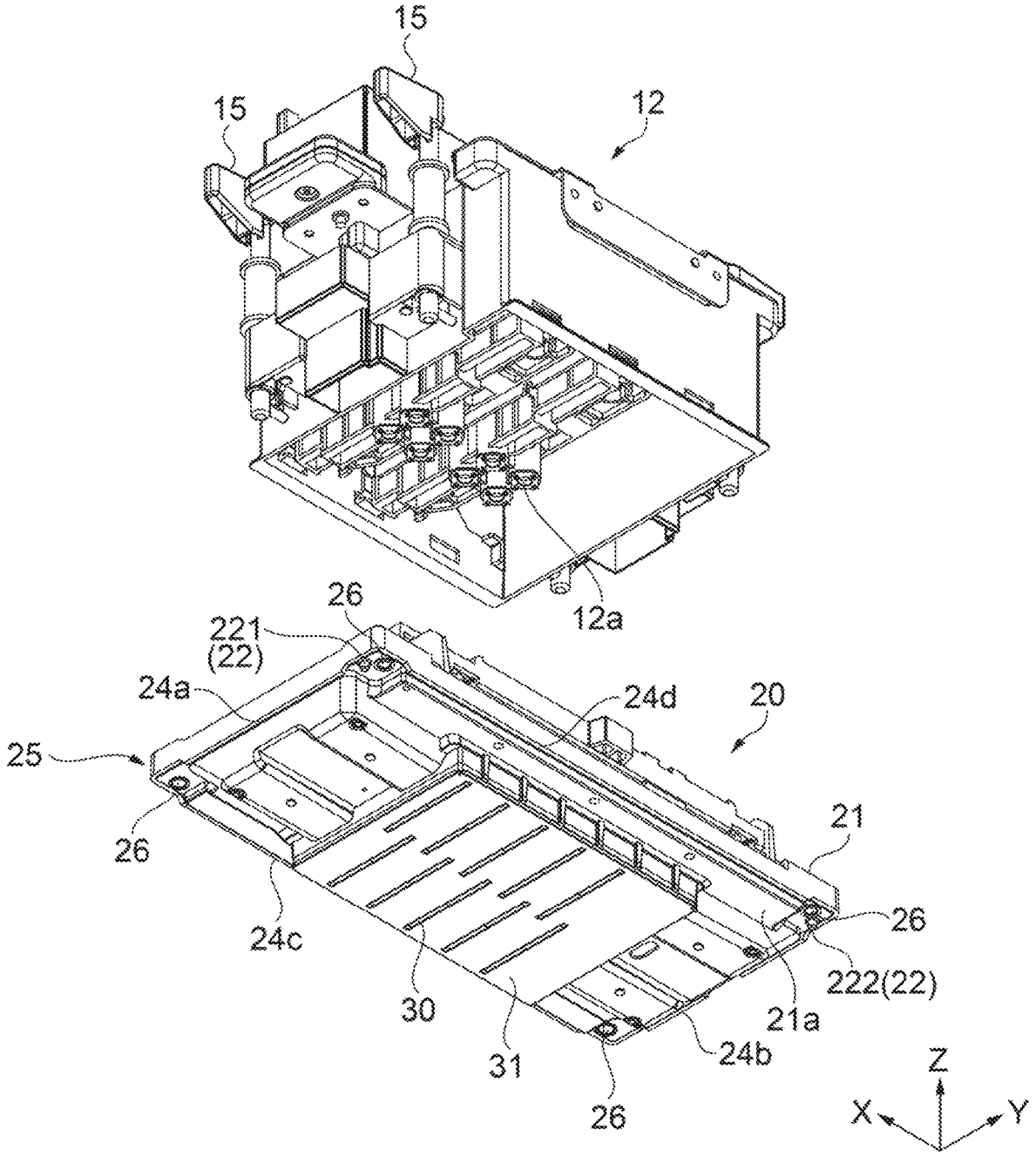
FIG. 7 is a perspective view illustrating a state where the head unit is separated from the liquid supply unit.

As illustrated in FIGS. 6 and 7, the liquid supply unit 12 has a coupling portion 12*a* coupled to the head unit 20. The coupling portion 12*a* functions as an ink flow path that communicates with each of the heads 30 provided at the head unit 20. The liquid supply unit 12 stores liquid and functions as a pressure regulating valve that opens and closes the ink flow path in accordance with a pressure on a side of each head 30. Such a liquid supply unit 12 has four fixing levers 15 engaged with the head unit 20 and is configured to be removable from the head unit 20 by operating the fixed lever 15. In FIGS. 6 and 7, for convenience of explanation, illustration of a part of the tube 14 and a BtoB connector 50 is omitted.

As illustrated in FIGS. 3 and 5, a supply unit placement portion 48 on which the liquid supply unit 12 removed from the head unit 20 can be placed is coupled to the carriage 40. The supply unit placement portion 48 is coupled to a left side wall of the carriage 40 that faces an attachment position of the filter 13 described above. In other words, with the head unit 20 attached to the carriage 40, the supply unit placement portion 48 is provided at a position opposite to the filter 13 with the head unit 20 interposed therebetween. In this way, compared to a case where the supply unit placement portion 48 is provided at an identical position to that of the filter 13 with the head unit 20 interposed therebetween, when the liquid supply unit 12 is placed on the supply unit placement portion 48, application of a load on the tube 14 due to the tube 14 folded back at a position where the filter 13 is provided is suppressed. The supply unit placement portion 48 is a frame-shaped member having a base 48*b*, and one side forming a frame 48*a* is rotatably coupled to an upper end of the left side wall of the carriage 40. The supply unit placement portion 48 is fixed by screws or the like at a position for covering an upper side of the liquid supply unit 12 with the base 48*b* facing upward in a printing operation for performing printing. As illustrated in FIG. 5, in a replacement operation for replacing the head unit 20, the supply unit placement portion 48 is rotated with the upper end of the left side wall of the carriage 40 as a fulcrum and is unfolded toward a left outside of the carriage 40. This brings into a state in which the supply unit placement portion 48 has the frame shape with the base 48*b* being on a lower side and the liquid supply unit 12 can be placed.

As illustrated in FIG. 7, the head unit 20 includes the plurality of heads 30 and a support portion 21 supporting the plurality of heads 30. The head unit 20 is constituted by, for example, the plurality of heads 30 having nozzles that discharge liquid such as color inks including a cyan ink C, a magenta ink M, a yellow ink Y, and a black ink K, and a white ink W for base formation. The liquid is supplied to each head 30 via the liquid supply unit 12 from the liquid supply source such as an ink pack or an ink tank. Note that, the white ink W is an ink for base formation, and is used for a region where an image of desired colors is formed without being affected by a color of the medium, to form a base of the image. Note that, the white ink W is also used as an image forming ink when a white image is formed. Also, the number and types of the inks described above are an example and are not limited thereto. Each head 30 discharges the liquid as droplets in the discharge direction based on the control by the control unit 8.

A piezo method is used as a pressure generating measure for discharging the droplets. The piezo method is a method in which a pulse is applied to a piezoelectric element that presses a pressure chamber corresponding to each nozzle, a pressure is applied to ink stored in the pressure chamber, and droplets are discharged from the nozzle communicating with the pressure chamber. Note that, an electrostatic actuator or the like that presses a pressure chamber by electrostatic force may be used as the pressure generating measure. Further, a head may be used in which liquid is discharged as droplets by bubbles generated by using a heating element.

The support portion 21 has a rectangular plate shape that is long along the X-axis, and has a bottom surface 21*a* formed of an outer edge 24 including a first side 24*a* parallel to the Y-axis and a second side 24*b* parallel to the first side 24*a*. The outer edge 24 further includes a third side 24*c* intersecting with the first side 24*a* and a fourth side 24*d* parallel to the third side 24*c*. The first side 24*a* and the second side 24*b* are short sides forming a rectangular shape. The third side 24*c* and the fourth side 24*d* are long sides forming the rectangular shape.

Each head 30 is coupled to the support portion 21 of the head unit 20 by a screw or the like. Each head 30 has a nozzle surface 31 formed with nozzles that discharge liquid supplied from the liquid supply unit 12 downward as droplets. The support portion 21 is provided with at least one protruding portion 22 protruding downward from the bottom surface 21*a* of the support portion 21. The protruding portion 22 extends in a cylindrical shape from the bottom surface 21*a*. Two number of the protruding portions 22 of the present exemplary embodiment are provided at both end portions of the third side 24*c*. The number of protruding portions 22 provided at the support portion 21 may be one, or may be three or more.

In addition, each of four corner portions 25 of the support portion 21 is provided with a through hole 26 for inserting a knurled screw 54 described below.

Figure 8:
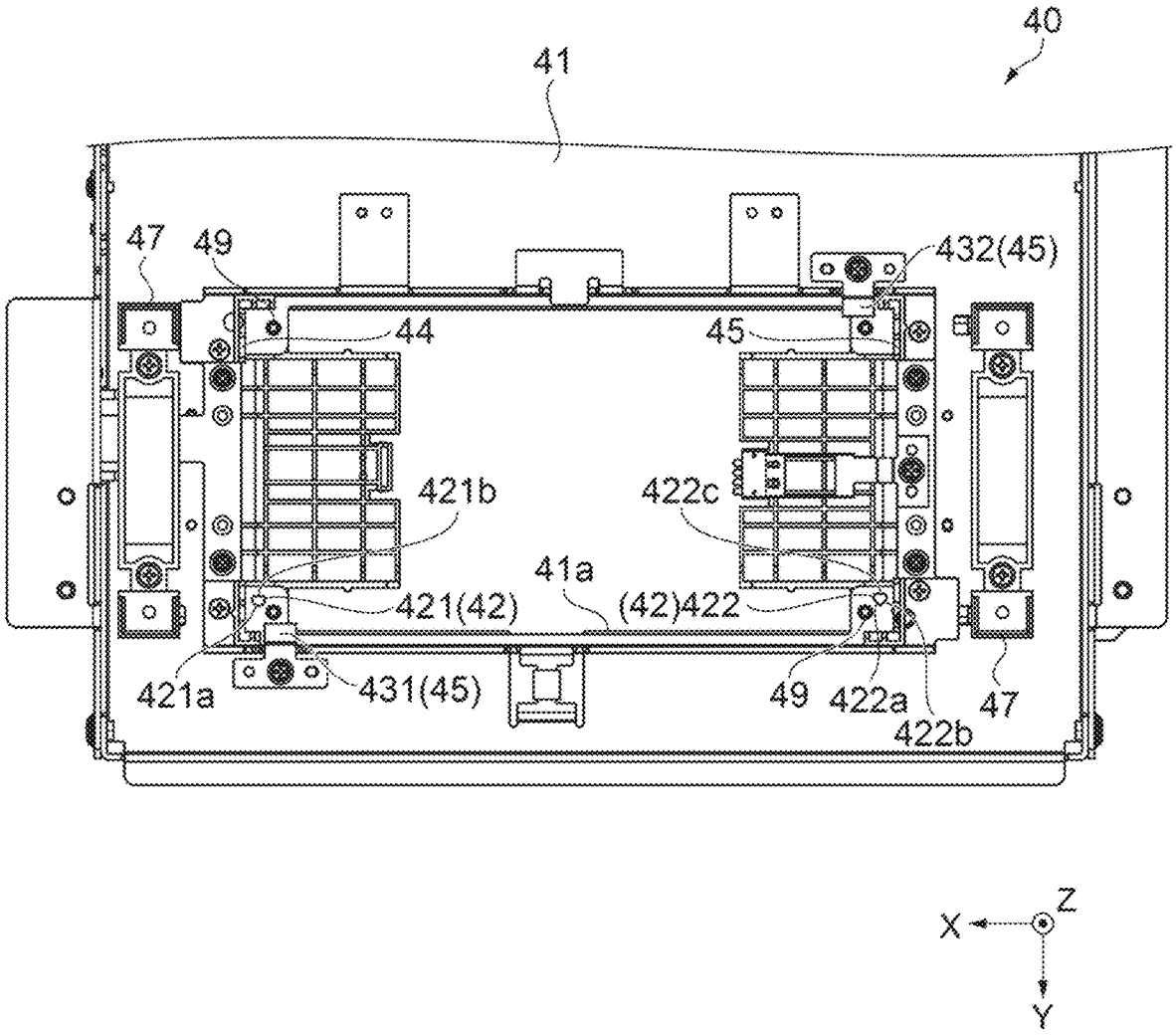
FIG. 8 is a plan view illustrating a configuration of a bottom of the carriage.

As illustrated in FIG. 8, the carriage 40 has a bottom 41 formed with an opening 41*a* that exposes the nozzle surface 31 of the head 30 for discharging droplets. Two insertion holes 42 through which the protruding portions 22 provided at the bottom surface 21*a* of the head unit 20 are inserted respectively are provided in the bottom 41 of the carriage 40. The insertion holes 42 having the number corresponding to the protruding portions 22 are formed at positions corresponding to the protruding portions 22. A first insertion hole 421 of the two insertion holes 42 is constituted by a curved inner wall 421*a* that is an inner wall having a curved surface shape and a planar inner wall 421*b* that is an inner wall having a planar surface. Additionally, a second insertion hole 422 of the two insertion holes 42 includes a planar inner wall 422*a*, a planar inner wall 422*b*, and a planar inner wall 422*c*. The planar inner wall 422*a* and the planar inner wall 422*b* each have a surface along a direction intersecting with the X-axis and the Y-axis. In addition, the at least one protruding portion 22 includes a first protruding portion 221 corresponding to the first insertion hole 421, and a second protruding portion 222 corresponding to the second insertion hole 422. A dimension of the insertion hole 42 along the X-axis is a dimension with which a cylinder forming the protruding portion 22 fits to the insertion hole 42. A dimension of the insertion hole 42 along the Y-axis is a dimension with which the cylinder forming the protruding portion 22 loosely fits to the insertion hole 42. The fitting represents a state of fitting to each other without a gap, and the loose fitting represents a state of fitting to each other with a slight gap.

When the head unit 20 is placed on the bottom 41 from above the carriage 40, the protruding portion 22 and the insertion hole 42 are in the loose fit state in a direction along the Y-axis, thus the head unit 20 can be easily placed on the carriage 40. In addition, since the protruding portion 22 and the insertion hole 42 are in the fitting state in a direction along the X-axis, a position of the head unit 20 with respect to the carriage 40 in the direction along the X-axis is precisely determined.

Note that, in the present exemplary embodiment, the configuration in which the insertion hole 42 is provided in the bottom 41 of the carriage 40 is illustrated, but a configuration may be adopted in which the insertion hole 42 is provided in a member coupled to the bottom 41 of the carriage 40.

As illustrated in FIGS. 7 and 8, the bottom 41 of the carriage 40 is provided with a first abutting portion 44 abutting on the first side 24*a* forming the bottom surface 21*a* in the support portion 21 of the head unit 20, and a second abutting portion 45 abutting on the second side 24*b* forming the bottom surface 21*a*. A configuration may be adopted in which the first abutting portion 44 is, in the first side 24*a* corresponding thereto, provided in a central portion of the side 24*a*, and the second abutting portion 45 is, in the second side 24*b* corresponding thereto, provided in a central portion of the side 24*b*, or a configuration may be adopted in which one or two number of the first abutting portions 44 are provided at both end portions of the side 24*a* and one or two number of the second abutting portions 45 are provided at both end portions of the side 24*b*. The first abutting portion 44 of the present exemplary embodiment is provided at each of a position corresponding to the corner 25 formed by the first side 24*a* and the third side 24*c*, and a position corresponding to the corner 25 formed by the first side 24*a* and the fourth side 24*d*. The second abutting portion 45 is provided at each of a position corresponding to the corner 25 formed by the second side 24*b* and the third side 24*c*, and a position corresponding to the corner 25 formed by the second side 24*b* and the fourth side 24*d*.

A shape of the first abutting portion 44 located at the corner 25 between the first side 24*a* and the third side 24*c* will be described. Note that, the second abutting portion 45 located at the corner 25 between the second side 24*b* and the third side 24*c* has a symmetrical shape with respect to the Y-axis with the first abutting portion 44 described below, and the first abutting portion 44 located at the corner 25 between the first side 24*a* and the fourth side 24*d* has a symmetrical shape with respect to the X-axis with the first abutting portion 44, and thus descriptions thereof will be omitted.

As illustrated in FIGS. 7 to 10, when the head unit 20 is placed on the bottom 41 of the carriage 40 in plan view from a +Z direction, the first abutting portion 44 has an L-shape that is capable of abutting on the first side 24*a*, which is the short side of the head unit 20, and the third side 24*c*, which is the long side of the head unit 20. The first abutting portion 44 has an inclined surface 46*a* along the first side 24*a* and an inclined surface 46*b* along the third side 24*c*. The inclined surface 46*a* inclines in a direction away from the first side 24*a* while proceeding upward. The inclined surface 46*b* inclines in a direction away from the third side 24*c* while proceeding upward.

In other words, the first abutting portion 44 and the second abutting portion 45 located facing each other in an X direction have the inclined surfaces 46*a* that incline toward directions away from each other. In other words, an interval between the first abutting portion 44 and the second abutting portion 45 increases while proceeding upward. A narrowest interval between the inclined surface 46*a* of the first abutting portion 44 and the inclined surface 46*a* of the second abutting portion 45 is an interval when the inclined surfaces 46*a* abuts on both ends of the third side 24*c* along the X-axis without gaps respectively. Thus, the position of the head unit 20 with respect to the carriage 40 in the direction along the X-axis is precisely determined.

Similarly, two number of the first abutting portions 44 located facing each other in a Y direction have the inclined surfaces 46*b* that incline toward directions away from each other. In other words, an interval between the two first abutting portions 44 increases while proceeding upward. A narrowest interval between the inclined surfaces 46*b* of the respective two first abutting portions 44 is an interval when there is some play between the inclined surface 46*b* and each of both ends of the first side 24*a* along the Y-axis. This allows the head unit 20 to be easily placed on the carriage 40.

Furthermore, the insertion hole 42 through which the protruding portion 22 described above is inserted is disposed at a position surrounded by the L-shape, which is the shape of the first abutting portion 44 or the second abutting portion 45. Each of the abutting portions 44 and 45 having the L-shape is disposed near the insertion hole 42, which is central to the positioning of the head unit 20 with respect to the carriage 40, to improve the positioning accuracy of the head unit 20 with respect to the carriage 40.

Figure 9:
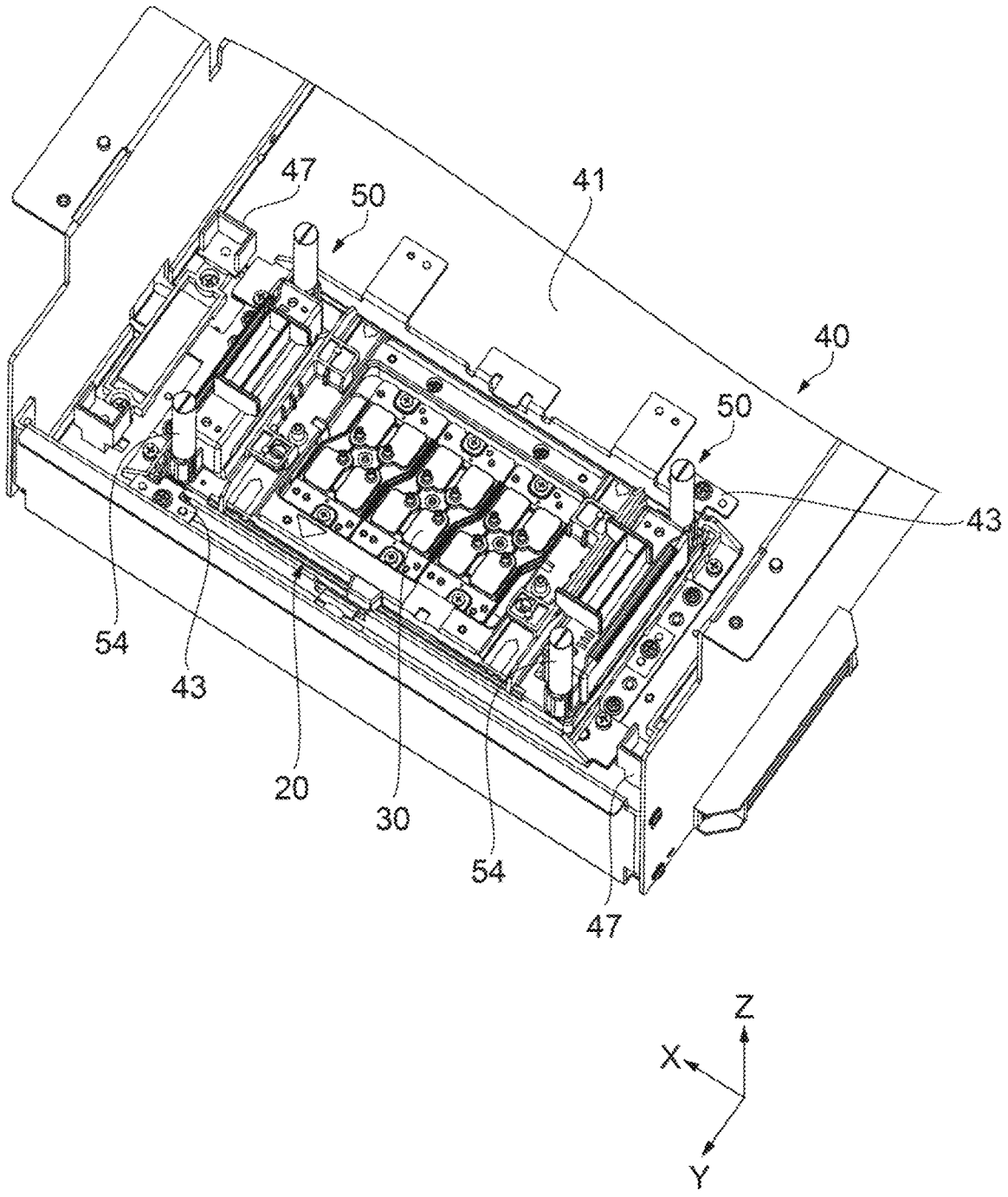
FIG. 9 is a perspective view illustrating a state where the head unit is mounted on the carriage.
Figure 10:
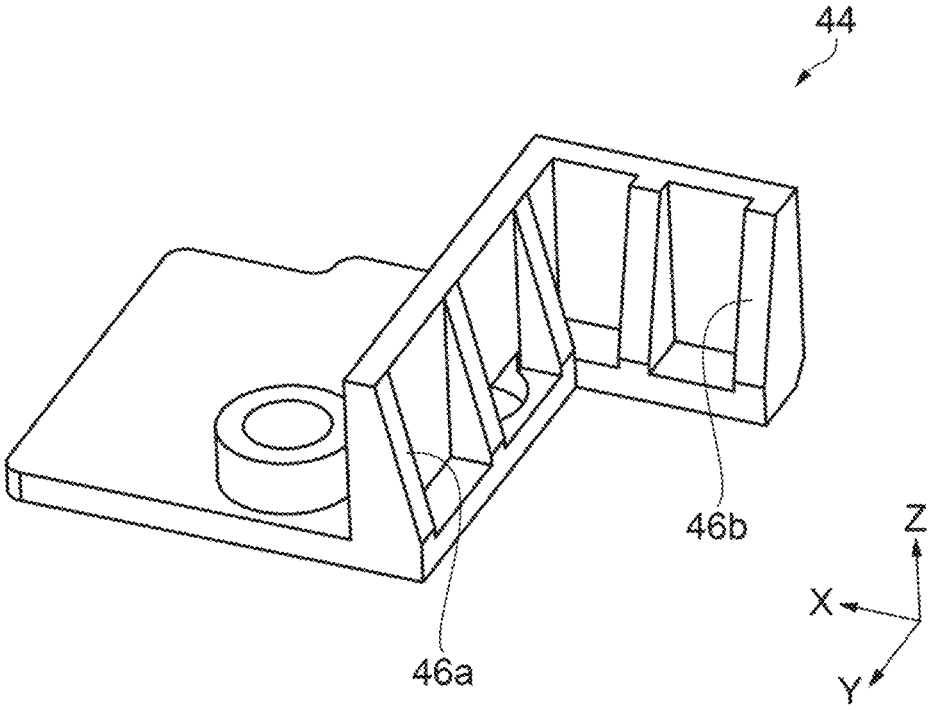
FIG. 10 is an enlarged perspective view illustrating a shape of a first abutting portion.

As illustrated in FIGS. 7 to 9, in a state where the protruding portion 22 provided at the bottom surface 21*a* in the support portion 21 of the head unit 20 is inserted through the insertion hole 42 provided in the bottom 41 of the carriage 40, at least one biasing member 43 that biases the support portion 21 in an intersecting direction intersecting with the Z-axis is provided at the bottom 41. The biasing member 43 of the present exemplary embodiment includes a first biasing member 431 provided at a position corresponding to a side of the fourth side 24*d* of the corner 25 formed by the first side 24*a* and the fourth side 24*d* of the head unit 20, and a second biasing member 432 provided at a position corresponding to a side of the third side 24*c* of the corner 25 formed by the second side 24*b* and the third side 24*c*.

The biasing member 43 is a leaf spring, and the second biasing member 432, when the head unit 20 is placed on the bottom 41 from above the carriage 40, biases the head unit 20 in one direction parallel to the Y-axis with respect to the carriage 40. The first biasing member 431 biases the head unit 20 in another direction on an opposite side of the one direction parallel to the Y-axis with respect to the carriage 40. Thus, the protruding portion 22 is biased toward the inner wall constituting the insertion hole 42 corresponding to the protruding portion 22, and a position of the head unit 20 with respect to the carriage 40 in the direction along the Y-axis is precisely determined. In the present exemplary embodiment, the first protruding portion 221 is biased by the first biasing member 431 on the inner walls (the curved inner wall 421*a* and the planar inner wall 421*b*) that constitute the first insertion hole 421. Thus, the head unit 20 can rotate with the first insertion hole 421 and the first protruding portion 221 as a rotation fulcrum. Since the first insertion hole 421 has the curved inner wall 421*a*, the head unit 20 can rotate smoothly. Then, the second protruding portion 222 abuts on the planar inner wall 422*a* and the planar inner wall 422*b* while being biased by the second biasing member 432, and a rotation range of the head unit 20 is regulated. The second protruding portion 222 abuts on the planar inner wall 422*a* and the planar inner wall 422*b* each having the flat surface along the direction intersecting with the X-axis and the Y-axis while being biased, thus respective positions of the second protruding portion 222 with respect to the carriage 40 in the X-axis and the Y-axis are determined precisely. Since the second protruding portion 222 is fixed to the head unit 20, respective positions of the head unit 20 in the X-axis and the Y-axis with respect to the carriage 40 are also precisely determined.

Note that, the biasing member 43 may be a helical spring, a torsion coil spring, an elastic member made of resin, or the like. In addition, the attachment position and the number of the biasing members 43 illustrated in the present exemplary embodiment are an example. The number of biasing members 43 may be one or more than three. Further, the attachment position of the biasing member 43 is not limited as long as biasing force can be generated in a predetermined direction. Further, as long as the first protruding portion 221 is designed to fit exactly on the inner walls (the curved inner wall 421*a* and the planar inner wall 421*b*) constituting the first insertion hole 421, the first biasing member 431 may be omitted.

As illustrated in FIGS. 4 and 9, a communication cable 11 is coupled to the head unit 20 for making electrical conduction with the control unit 8. The communication cable 11 is coupled to the support portion 21 via the board-to-board connector 50. Note that, illustration of the communication cable 11 is omitted in FIG. 9. Hereinafter, the board-to-board connector is referred to as a BtoB connector. The BtoB connector 50 includes a male side BtoB connector 51 and a female side BtoB connector 52. Specifically, the BtoB connector 50 has a rectangular shape in plan view from the +Z direction. As illustrated in FIG. 6, two number of the male side BtoB connectors 51 are provided at a position along the first side 24*a* and a position along the second side 24*b* on an upper surface 21*b* of the support portion 21 respectively.

Figure 11:
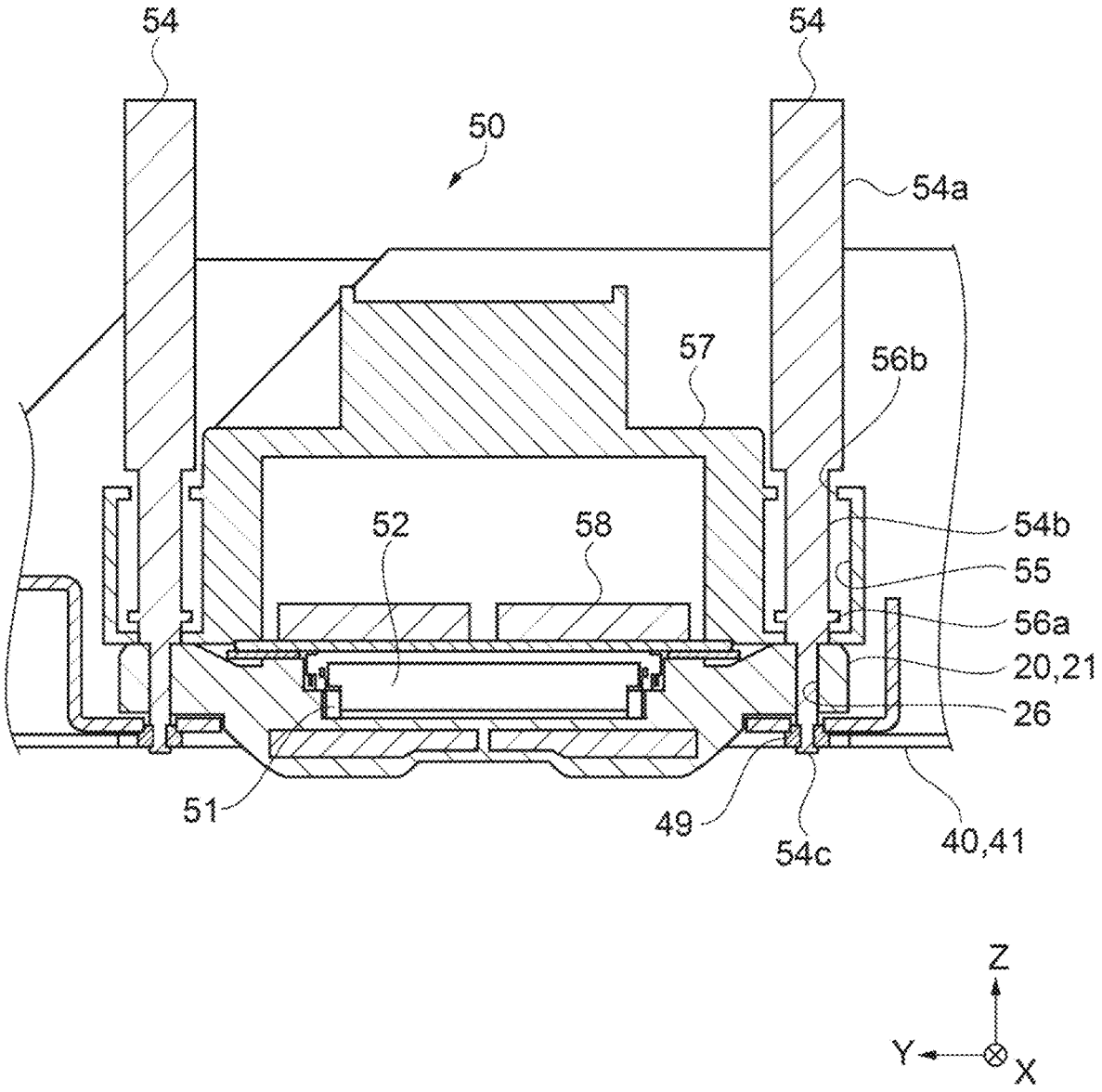
FIG. 11 is a cross-sectional view illustrating a configuration of a board-to-board connector.

As illustrated in FIG. 11, the communication cable 11 is coupled to the male side BtoB connector 51 via the female side BtoB connector 52. Note that, in FIG. 11, illustration of the communication cable 11 and some members is omitted. The communication cable 11 is a flexible flat cable. Hereinafter, the communication cable 11, which is the flexible flat cable, is also referred to as an FFC 11. The female side BtoB connector 52 includes a rectangular box shaped holder 57 that is long in the Y direction in plan view from the +Z direction. The FFC 11 is electrically coupled to a connector 58 for FFC provided inside the holder 57, and is further converted to the female side BtoB connector 52 provided at a bottom of the holder 57. There was a possibility that coupling the FFC 11 and the connector 58 for FFC causes failures such as mis-insertion of the FFC 11 and connector breakage. According to this configuration, it is possible to easily make electrical conduction between the control unit 8 and the head unit 20 by plugging and unplugging the BtoB connector 50 rather than plugging and unplugging the FFC 11.

The female side BtoB connector 52 and the support portion 21 of the head unit 20 are fixed to the bottom 41 of the carriage 40 by the knurled screw 54 as a screw. The holder 57 is provided with a through hole 55 through which the knurled screw 54 is inserted along the Z-axis, and the support portion 21 is provided with the through hole 26 through which the knurled screw 54 is inserted along the Z-axis. The knurled screws 54 are provided at both end portions of the holder 57 of the female side BtoB connector 52, which is long in the Y direction, in plan view from the +Z direction respectively. The female side BtoB connector 52 is rectangular and is located on a virtual straight line connecting the two knurled screws 54 to each other. Thus, even when fitting between the male side BtoB connector 51 and the female side BtoB connector 52 is in an insufficient state, force for tightening the knurled screw 54 is effectively transmitted to the BtoB connector 50, and the fitting is normally made by tightening the knurling screw 54.

The BtoB connector 50, in a state where the knurled screw 54 is fully tightened, may be fitted to a degree in which electrical conduction can be made. Thus, application of excessive stress to the BtoB connector 50 and occurrence of defects can be suppressed. Note that, the description has been given that the BtoB connector 50 makes electrical conduction, but a connector that couples light delivered by an optical fiber or the like may be used.

The knurled screw 54 is a fall preventing screw that prevents itself from falling out of the through hole 55 of the holder 57. In particular, the knurled screw 54 of the present exemplary embodiment has a head 54*a* knurled, a cylindrical portion 54*b* extending from the head 54*a*, and a threaded portion 54*c* formed with threads on a leading end portion. The threaded portion 54*c* engages with a thread engaging portion 49 provided at the bottom 41 of the carriage 40 in conjunction with rotation of the head 54*a*.

The cylindrical portion 54*b* is provided with a ring-shaped protruding portion 56*a* protruding in a direction intersecting with a circumferential direction. A diameter of the through hole 55 of the holder 57 is substantially identical to a diameter of the protruding portion 56*a*, and an upper end of the through hole 55 is provided with an annular stopper portion 56*b* having a diameter less than the diameter of the protruding portion 56*a*. The protruding portion 56*a* is located in the through hole 55 of the holder 57, and movement of the protruding portion 56*a* outside the through hole 55 is regulated by the stopper portion 56*b*. That is, the knurled screw 54 is configured not to be separated from the holder 57.

As illustrated in FIG. 9, a connector placement portion 47 on which the female side BtoB connector 52 removed from the male side BtoB connector 51 provided at the support portion 21 is placed is provided at the bottom 41 of the carriage 40. In a state where the head unit 20 is mounted on the carriage 40, the connector placement portions 47 are provided at two positions along the two number of the male side BtoB connectors 51.

1-3. Method of Replacing Head Unit

Figure 12:
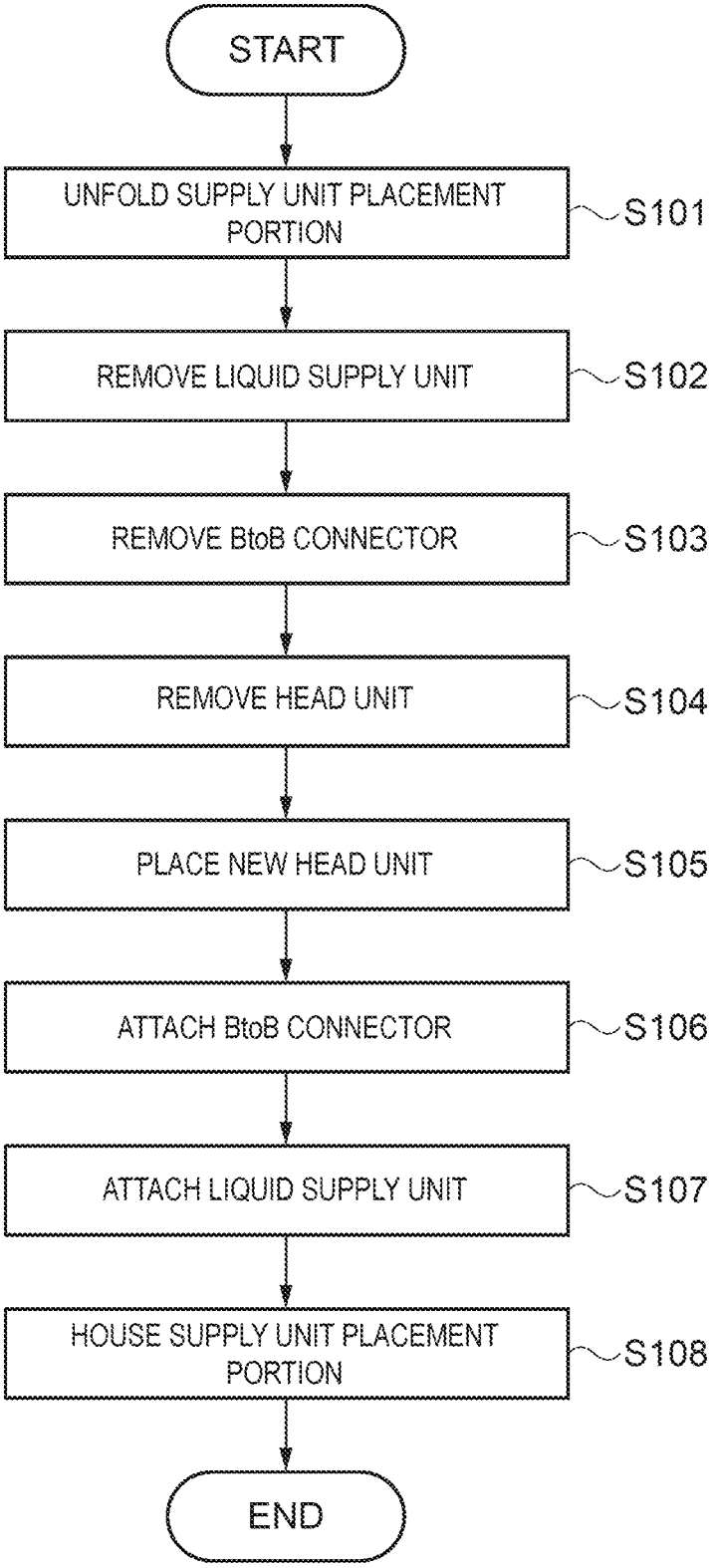
FIG. 12 is a flow chart illustrating a method of replacing the head unit.

Next, a method of replacing the head unit 20 will be described based on a flowchart illustrated in FIG. 12.

In step S101, the supply unit placement portion 48 is unfolded. As illustrated in FIGS. 2 and 3, a user opens the lid 9 and removes the carriage cover 17 covering the carriage 40 from above. Then, as illustrated in FIG. 5, the user unfolds the supply unit placement portion 48 from the carriage 40, and brings into a state where the liquid supply unit 12 can be placed.

Figure 13:
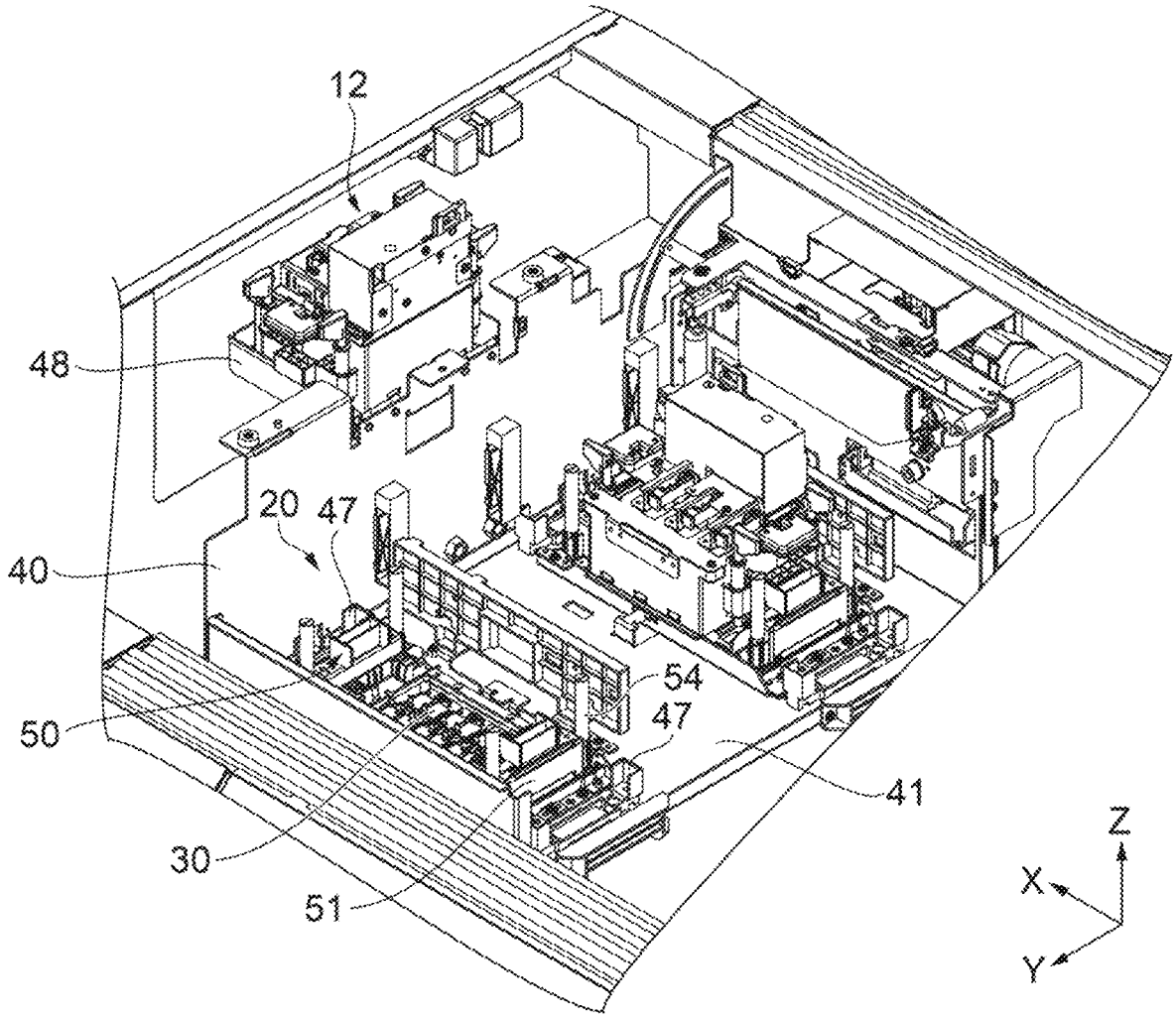
FIG. 13 is a perspective view illustrating a state where the liquid supply unit is placed on the supply unit placement portion.
Figure 14:
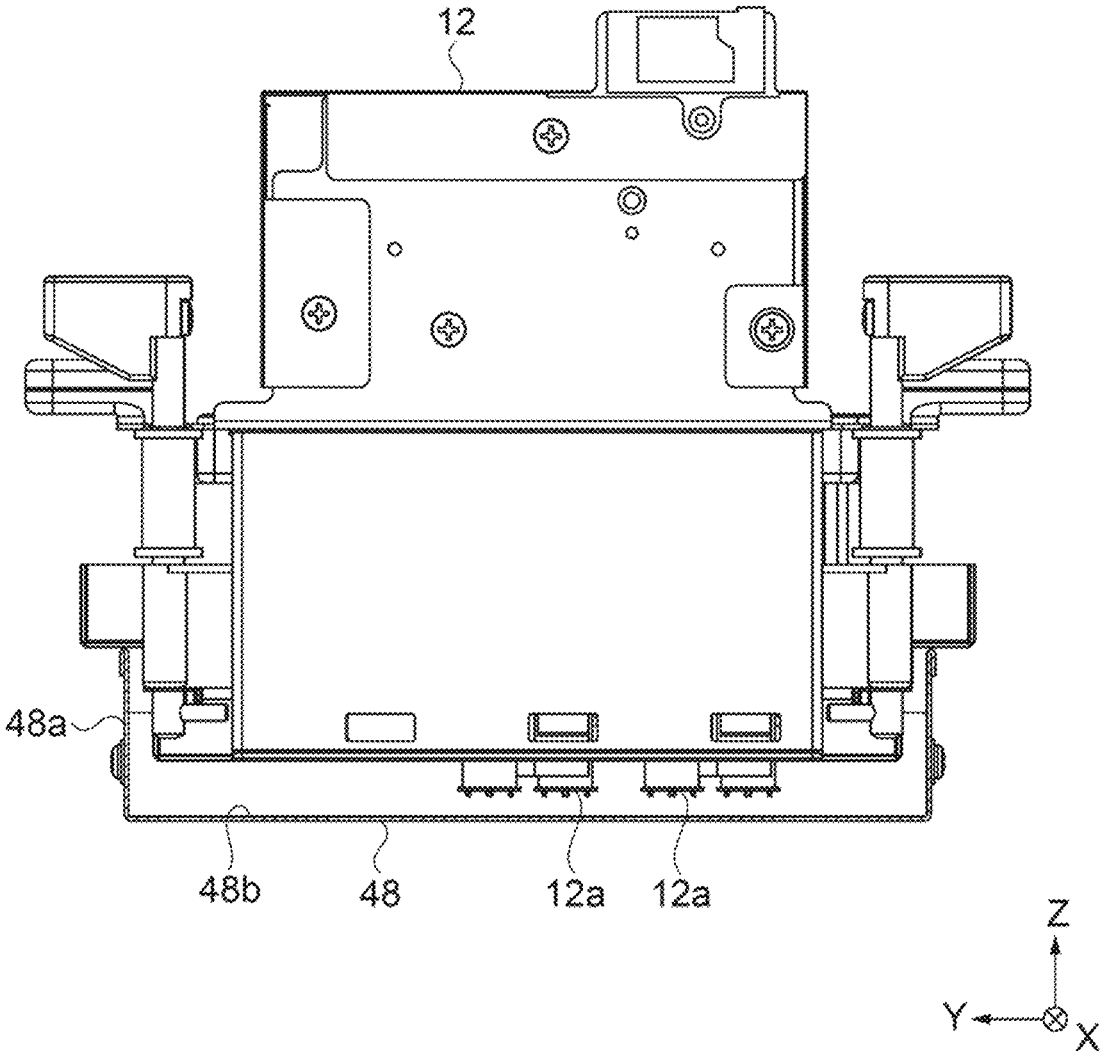
FIG. 14 is a cross-sectional view illustrating the state where the liquid supply unit is placed on the supply unit placement portion.

In step S102, the liquid supply unit 12 is removed. The user disengages the four fixing levers 15 engaged with the head unit 20, and removes the liquid supply unit 12 from the head unit 20. Then, as illustrated in FIG. 13, the user places the liquid supply unit 12 on the supply unit placement portion 48. At this time, a coupling portion 12*a* of the liquid supply unit 12 with the head unit 20 may be separated from the base 48*b* of the supply unit placement portion 48. FIG. 14 is a cross-sectional view of the liquid supply unit 12 in a state of being placed on the supply unit placement portion 48. A width of the frame 48*a* of the supply unit placement portion 48 is less than a width of the liquid supply unit 12, and a height of the frame 48*a* of the supply unit placement portion 48 is greater than a height of the coupling portion 12*a*. Thus, the coupling portion 12*a* can be separated from the base 48*b* of the supply unit placement portion 48.

Figure 15:
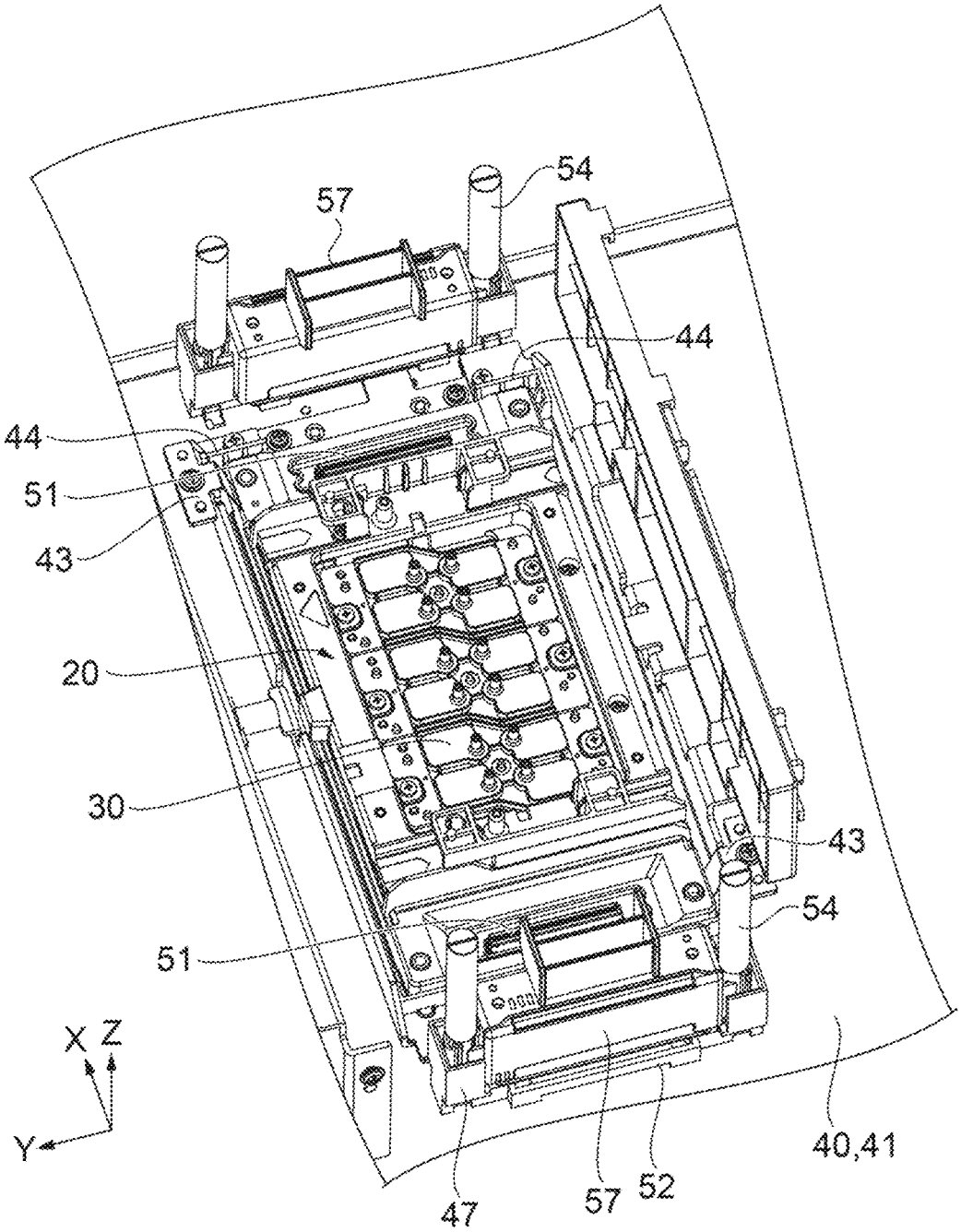
FIG. 15 is a perspective view illustrating a state where the liquid supply unit is removed from the head unit.

In step S103, the female side BtoB connector 52 is removed. The user disengages the knurled screw 54 engaging with the bottom 41 of the carriage 40. Then, as illustrated in FIG. 15, the user removes the female side BtoB connector 52 from the male side BtoB connector 51 provided at the support portion 21 of the head unit 20, and places the female side BtoB connector 52 on the connector placement portion 47.

Figure 16:
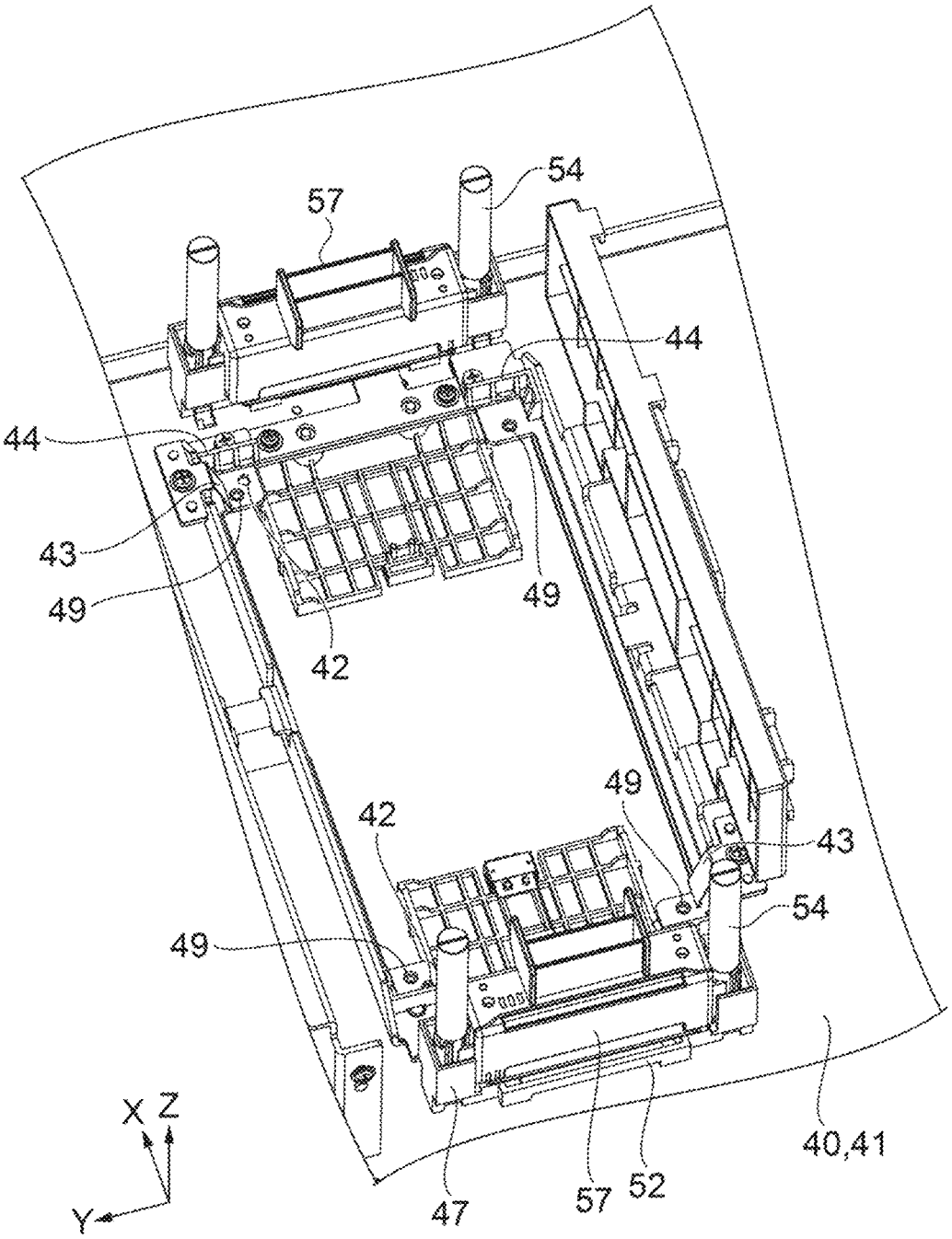
FIG. 16 is a perspective view illustrating a state where the head unit is removed from the carriage.

In step S104, the head unit 20 is removed. As illustrated in FIG. 16, the user removes the head unit 20 placed on the bottom 41 of the carriage 40.

In step S105, the head unit 20 that is new is placed. The user places the new head unit 20 on the bottom 41 of the carriage 40 along the first and second abutting portions 44 and 45 provided at the bottom 41 of the carriage 40. At this time, the protruding portion 22 protruding from the bottom surface 21*a* of the head unit 20 is inserted through the insertion hole 42 provided in the bottom 41 of the carriage 40, and a position in the direction along the X-axis is precisely determined. Furthermore, a position in the direction along the Y-axis is precisely determined due to biasing force by the biasing member 43.

In step S106, the female side BtoB connector 52 is attached. The user places the female side BtoB connector 52 placed on the connector placement portion 47 on the male side BtoB connector 51 provided at the new head unit 20, and engages the knurled screw 54 with the bottom 41 of the carriage 40. Thus, the male side BtoB connector 51 and the female side BtoB connector 52 are fitted to each other, and the support portion 21 of the head unit 20 is fixed to the bottom 41 of the carriage 40.

In step S107, the liquid supply unit 12 is attached. The user couples the liquid supply unit 12 placed on the supply unit placement portion 48 with the new head unit 20, and by the four fixing levers 15, engages the liquid supply unit 12 with the new head unit 20.

In step S108, the supply unit placement portion 48 is housed. The user rotates the supply unit placement portion 48 to return to a position for covering the upper side of the liquid supply unit 12. In addition, the user attaches the carriage cover 17, and closes the lid 9 of the housing 2. As described above, the replacement operation of the head unit 20 is completed.

As described above, according to the printing apparatus 1 and the carriage 40 according to Exemplary Embodiment 1, the following advantages can be provided.

The printing apparatus 1 includes the carriage 40 on which the head unit 20 is removably mounted. The head unit 20 is placed on the bottom 41 of the carriage 40 from upstream in the discharge direction. At this time, the protruding portion 22 is inserted through the insertion hole 42 provided in the bottom 41, and additionally, the head unit 20 is biased in the intersecting direction by the biasing member 43. Thus, the head unit 20 is precisely positioned with respect to the carriage 40, and thus the head 30 can be easily replaced. Accordingly, the printing apparatus 1 for which the user itself can perform head replacement can be provided.

A position of the head unit 20 in a direction intersecting with the first side 24*a* and the second side 24*b* is precisely determined by the first abutting portion 44 and the second abutting portion 45, and a position in a direction parallel to the first side 24*a* and the second side 24*b* is precisely determined by the biasing member 43. Thus, mounting position accuracy of the head unit 20 with respect to the carriage 40 is further improved.

The head unit 20 is mounted on the carriage 40 along the respective inclined surfaces 46*a* of the first and second abutting portions 44 and 45. Thus, the head unit 20 can be precisely and easily mounted between the first abutting portion 44 and the second abutting portion 45.

The first abutting portions 44 and the second abutting portions 45 are provided at respective positions corresponding to the four corner portions 25 of the outer edge 24 constituting the bottom surface 21*a*, thus the mounting position accuracy of the head unit 20 with respect to the carriage 40 is further improved.

The communication cable 11 is coupled to the male side BtoB connector 51 provided at the support portion 21 via the female side BtoB connector 52. By coupling the communication cable 11, which is the flexible flat cable, with the BtoB connector 50, the communication cable 11 can be easily attached and detached.

The female side BtoB connector 52 is provided with the through hole 55, and the support portion 21 of the head unit 20 is provided with the through hole 26. The female side BtoB connector 52 and the support portion 21 are fixed to the bottom 41 of the carriage 40 by the knurled screw 54 passing through the through holes 26 and 55. Thus, electrical coupling between the male side BtoB connector 51 and the female side BtoB connector 52 provided at the support portion 21, and coupling between the support portion 21 and the bottom 41 can be simultaneously made. Additionally, the knurled screw 54 is a fall preventing screw that prevents itself from falling out of the through hole 55 of the female side BtoB connector 52, and thus a loss of the knurled screw 54 during a head replacement operation can be suppressed.

The carriage 40 is provided with the connector placement portion 47 on which the female side BtoB connector 52 removed from the support portion 21 is placed. This makes it possible to place the female side BtoB connector 52 on the connector placement portion 47 during the head replacement operation, and operability of the head replacement is improved.

The supply unit placement portion 48 on which the liquid supply unit 12 removed from the head unit 20 can be placed is coupled to the carriage 40. This makes it possible to place the liquid supply unit 12 on the supply unit placement portion 48 during the head replacement operation, and the operability of the head replacement is improved.

When the liquid supply unit 12 is placed on the supply unit placement portion 48, the coupling portion 12*a* of the liquid supply unit 12 is separated from the base 48*b* of the supply unit placement portion 48. That is, since liquid does not adhere to the supply unit placement portion 48, occurrence of cleaning operations associated with the head replacement is suppressed.

The carriage 40 includes the bottom 41 on which the head unit 20 is removably placed from upstream in the discharge direction. When the head unit 20 is placed on the bottom 41, the protruding portion 22 is inserted through the insertion hole 42 provided in the bottom 41, and additionally, the head unit 20 is biased in the intersecting direction by the biasing member 43. Thus, the head unit 20 is precisely positioned with respect to the carriage 40, and thus the head 30 can be easily replaced. Accordingly, the carriage 40 can be provided for which the user itself can perform head replacement.

2. Exemplary Embodiment 2

A schematic configuration of a printing apparatus 101 according to Exemplary Embodiment 2 will be described with reference the drawings. Note that, an identical configuration to that in Exemplary Embodiment 1 is given an identical reference sign, and redundant description thereof will be omitted. In addition, both directions along the X-axis correspond to a main scanning direction, and the Y-axis corresponds to a transport direction of a printing unit 170.

The printing apparatus 101 is an ink-jet type printer for discharging droplets on the medium S with a lower side along the Z-axis (−Z direction) as a discharge direction, to print a desired image.

Figure 17:
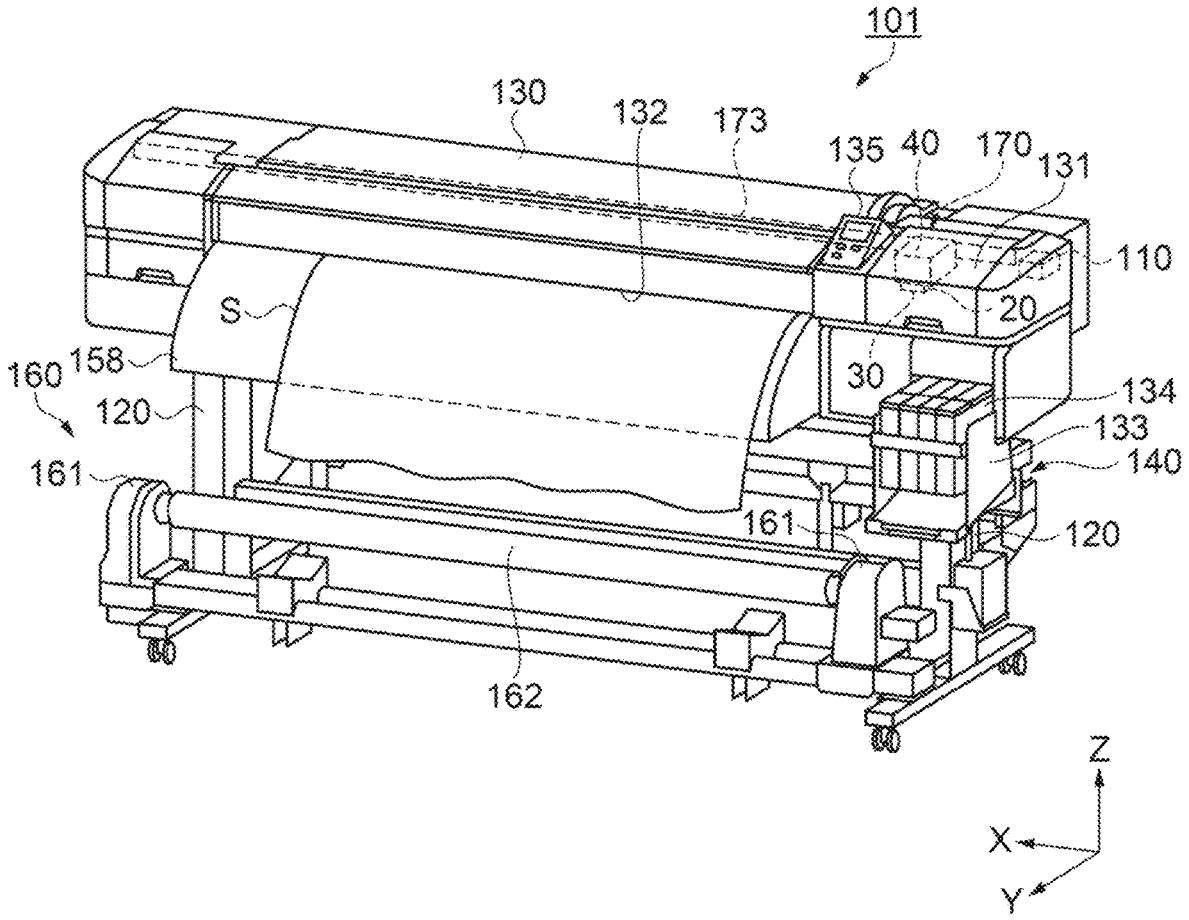
FIG. 17 is a perspective view illustrating a configuration of a printing apparatus according to Exemplary Embodiment 2.

As illustrated in FIG. 17, the printing apparatus 101 is configured to include a supply unit 140, a guide unit 158, a winding unit 160, the printing unit 170, and a control unit 110. The supply unit 140, the guide unit 158, and the winding unit 160 are coupled to a frame 120 having wheels attached to lower ends. The printing unit 170 is provided inside a substantially rectangular parallelepiped housing 130 that is long along the X-axis supported by the frame 120. The control unit 110 is provided inside the housing 130 to control operation of each unit of the printing apparatus 101.

The supply unit 140 is provided at a rear lower part of the housing 130. A roll body around which the medium S that is unused is wound is held in the supply unit 140. The supply unit 140 unwinds the medium S from the roll body to supply to the printing unit 170. Note that the roll body multi-sized and formed with the medium S having a different width and the different number of times of winding is replaceably loaded to the supply unit 140.

The winding unit 160 is provided at a front lower part of the housing 130. A roll body in which the medium S printed by the printing unit 170 is wound around a core tube 162 is formed in the winding unit 160. The winding unit 160 includes a pair of holders 161 that sandwich both ends of the core tube 162. One of the holders 161 is provided with a motor for supplying rotary power to the core tube 162. When the motor is driven and the core tube 162 rotates, the medium S is wound around the core tube 162. The winding unit 160 may be configured to be provided with a tension roller pressing a back surface side of the medium S hanging down under its own weight and applying tension to the medium S that is wound around the core tube 162.

The guide unit 158 is provided so as to protrude in an arc shape forward and backward the housing 130 from a platen that supports the medium S facing the printing unit 170, and supports the medium S from below. A supplying port for feeding the medium S inside the housing 130 is formed at a position on an upper side of the guide unit 158 on a rear face of the housing 130. A discharge port 132 for discharging the medium S outside the housing 130 is formed at a position on the upper side of the guide unit 158 on a front face of the housing 130.

A roller pair capable of sandwiching the medium S in the up-down direction is provided inside the housing 130. When the roller pair is driven in rotation, the medium S sandwiched by the roller pair is transported in the transport direction. The guide unit 158 guides the medium S supplied from the supply unit 140 to the printing unit 170, and guides the medium S printed by the printing unit 170 to the winding unit 160.

The printing unit 170 is disposed above where the platen is disposed. The printing unit 170 includes the head unit 20 having the plurality of heads 30 capable of discharging droplets onto the medium S, and the carriage 40 on which the head unit 20 is mounted. The head unit 20 is configured to be removable from an upper side that is upstream in the discharge direction with respect to the carriage 40. The removal of the head unit 20 is performed at a right end portion of the housing 130, and a lid 131 that covers the carriage 40 and the head unit 20 in an openable and closable manner is provided at that place.

Further, the printing unit 170 includes a guide rail 173 extending in the main scanning direction and fixed to the housing 130. The carriage 40 is supported by the guide rail 173, and is configured to be reciprocally movable in the main scanning direction by a motor. The head unit 20 reciprocates in the main scanning direction with the carriage 40. Printing is performed by the head unit 20 discharging droplets on the medium S while moving in the main scanning direction.

An operation unit 135 for performing a setting operation or an input operation is provided at an upper right portion of the housing 130. A container mounting portion 133 on which a liquid containing container 134 capable of containing liquid can be mounted is provided at a lower right portion of the housing 130. A plurality of the liquid containing containers 134 are mounted on the container mounting portion 133, corresponding to types and colors of liquids.

Note that, the printing apparatus 101 may have a configuration in which a heater for rapidly drying and fixing droplets on the medium S by heating the medium S is built in, or a configuration provided with a drying furnace.

Figure 18:
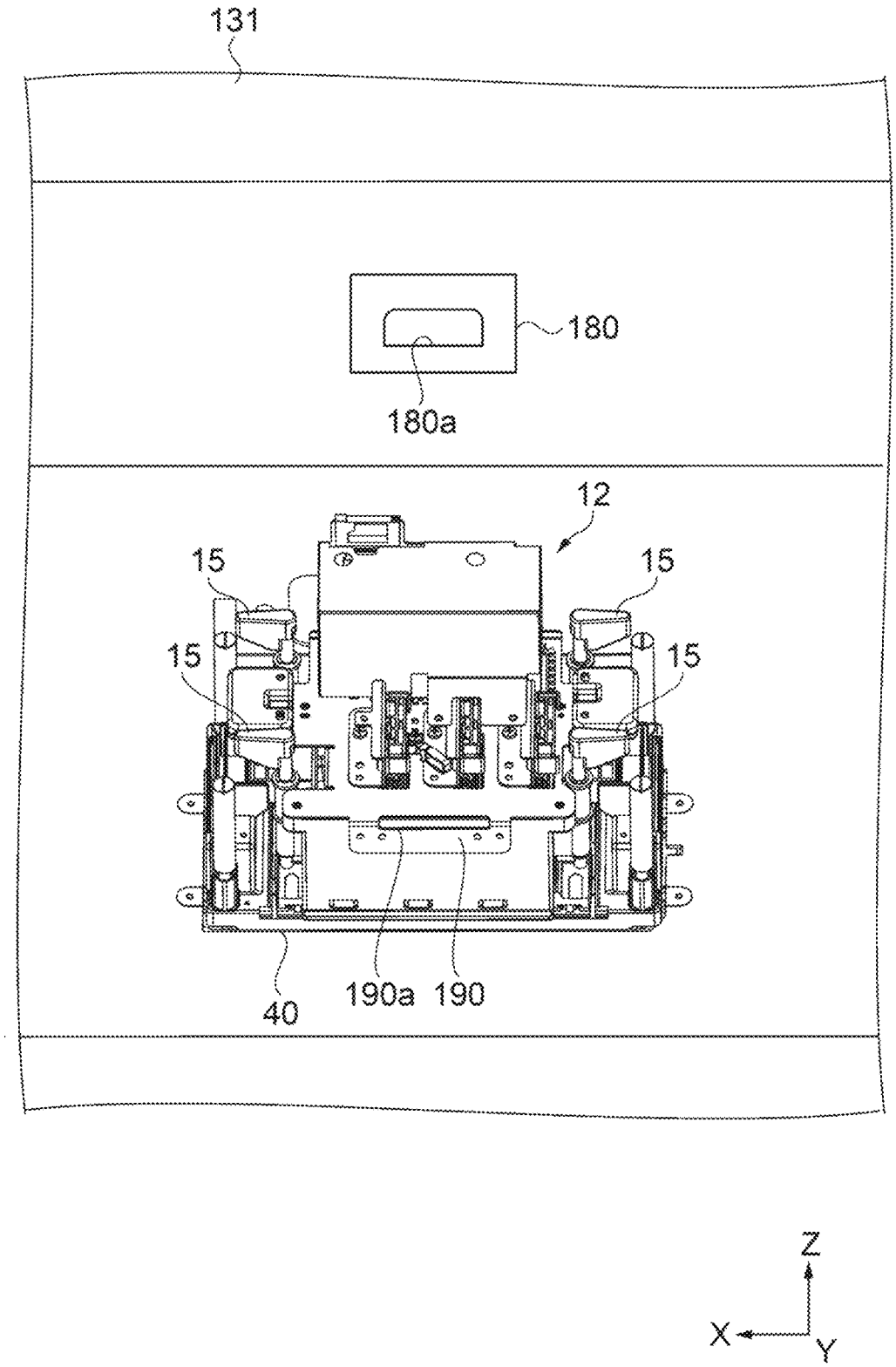
FIG. 18 is a perspective view enlarging and illustrating a part with a lid open.
Figure 19:
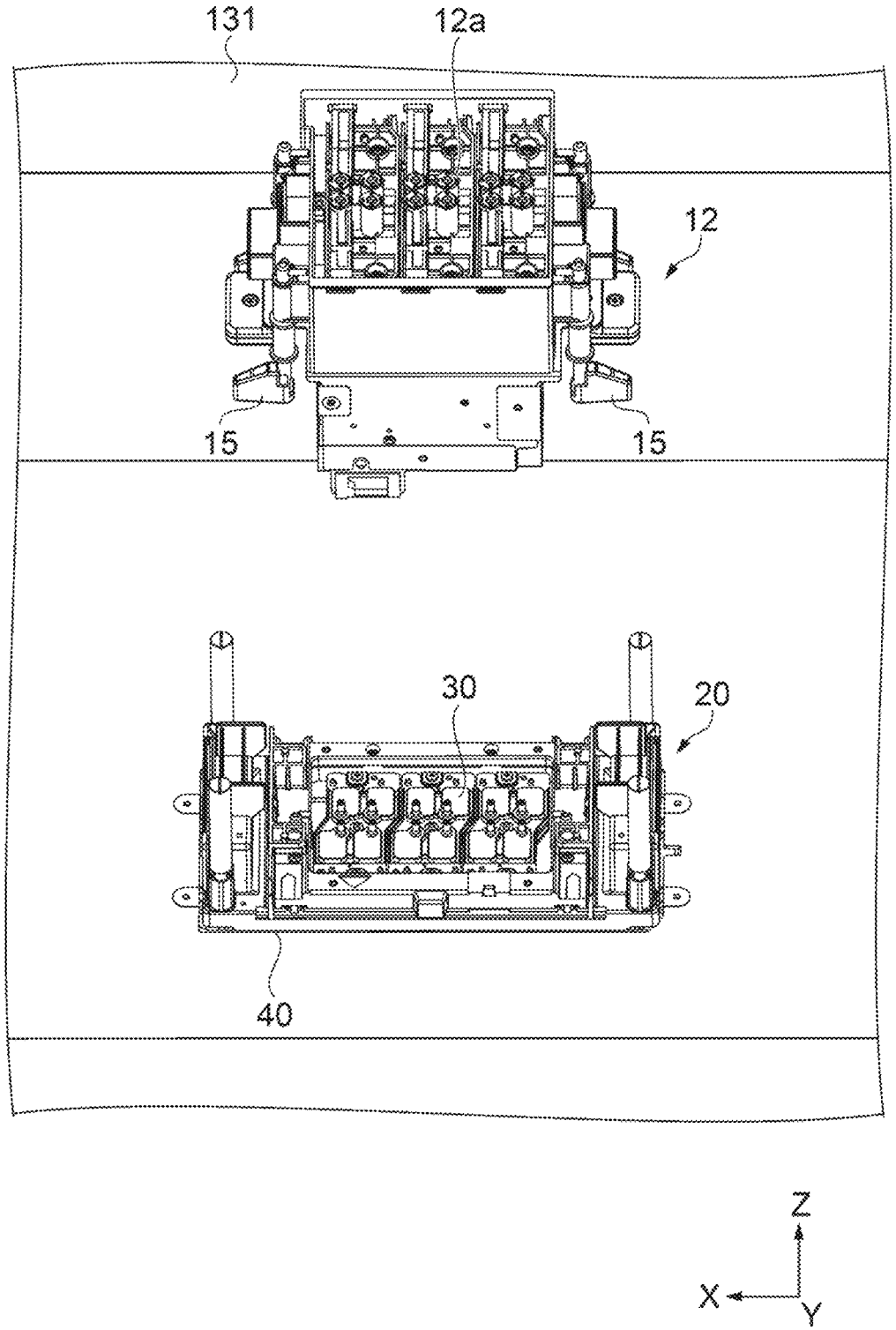
FIG. 19 is a perspective view illustrating a state where the liquid supply unit is engaged with the lid.

As illustrated in FIG. 18, an engaging portion 180 for engaging with the liquid supply unit 12 is provided inside the lid 131 that is opened for performing a replacement operation of the head unit 20. The engaging portion 180 has an extending portion **180*a* extending upward with the lid 131 open. The extending portion 180*a* is formed, for example, by bending a metal plate. Further, an engaged portion 190 that can engage with the engaging portion 180 is provided at a front face of the liquid supply unit 12. The engaged portion 190 has a notch 190*a* through which the extending portion 180*a* is inserted. The notch 190*a* is formed by drilling a metal plate, for example. As illustrated in FIG. 19, the liquid supply unit 12 is configured to be capable of engaging with an inside of the lid 131. Specifically, the extending portion 180*a* is inserted into and engaged with the notch 190*a*, and thus the liquid supply unit 12 is supported by the inside of the lid 131. That is, the extending portion 180*a* functions as a hook for hooking the engaged portion 190 having the notch 190*a*. In addition, in a state where the liquid supply unit 12 is engaged with the inside of the lid 131, respective shapes of the engaging portion 180 and the engaged portion 190 may be designed such that the coupling portion 12*a* faces upward in the Z direction. Thus, leakage of liquid from the coupling portion 12*a* can be suppressed. In FIGS. 18 and 19, for convenience of explanation, illustration of the side walls of the carriage 40, cables, and tubes is omitted. The user can efficiently engage the liquid supply unit 12 removed from the head unit 20 with the lid 131, in the replacement operation of the head unit 20. Thus, work efficiency when performing the replacement operation of the head unit 20** is improved.

Note that, the aspect of the engaging portion 180 and the engaged portion 190 is not limited to the above. For example, a notch may be formed in the engaging portion 180, and an extending portion that can be inserted into the notch may be formed in the engaged portion 190. For example, an aspect may be adopted in which a permanent magnet such as a neodymium magnet or an electrical magnet is employed as the engaging portion 180, and a ferromagnetic metal such as iron is employed as the engaged portion 190. For example, at least one groove that is parallel to the X-axis may be provided at the inside of the lid 131 as the engaging portion 180, and at least one protrusion that slides along the X-axis and engages with the at least one groove as the engaged portion 190 may be provided.

What is claimed is:

1. A printing apparatus, comprising:

a head unit having a support portion configured to support a plurality of heads configured to discharge a droplet in a discharge direction; and a carriage on which the head unit is removably mounted from upstream in the discharge direction, wherein the carriage has a bottom formed with an opening from which a nozzle surface of the head configured to discharge the droplet is exposed, the support portion is provided with at least one protruding portion protruding from a bottom surface of the support portion in the discharge direction, and the bottom is provided with an insertion hole through which the at least one protruding portion is inserted, and a biasing member configured to bias the support portion in an intersecting direction intersecting with the discharge direction in a state where the at least one protruding portion is inserted through the insertion hole.

2. The printing apparatus according to claim 1, wherein the bottom surface has an outer edge including a first side and a second side parallel to the first side, the bottom is provided with a first abutting portion configured to abut on the first side, and a second abutting portion configured to abut on the second side, and the biasing member configured to bias the support portion in a direction parallel to the first side and the second side.

3. The printing apparatus according to claim 2, wherein, the first abutting portion and the second abutting portion each have an inclined surface inclined in a direction away from each other, and an interval between the first abutting portion and the second abutting portion increases toward upstream in the discharge direction.

4. The printing apparatus according to claim 2, wherein each of the first abutting portion and the second abutting portion is provided at a position corresponding to a corner portion of the outer edge.

5. The printing apparatus according to claim 1, comprising:

a communication cable coupled to the head unit, wherein the communication cable is coupled to the support portion via a board-to-board connector.

6. The printing apparatus according to claim 5, wherein:

the board-to-board connector and the support portion are each provided with a through hole through which a screw configured to fix the board-to-board connector and the support portion to the bottom, and the screw is a fall preventing screw configured to prevent itself from falling out of the through hole of the board-to-board connector.

7. The printing apparatus according to claim 5, wherein the carriage is provided with a connector placement portion on which the board-to-board connector removed from the support portion is placed.

8. The printing apparatus according to claim 1, comprising:

a liquid supply unit coupled to the head unit and configured to supply liquid to the plurality of heads, wherein a supply unit placement portion, on which the liquid supply unit removed from the head unit is placeable, is coupled to the carriage.

9. The printing apparatus according to claim 8, wherein the supply unit placement portion is a frame shaped member having a base that is unfolded from the carriage, and in a state where the liquid supply unit is placed on the supply unit placement portion, a coupling portion of the liquid supply unit coupled to the head unit is separated from the base of the supply unit placement portion.

10. The printing apparatus according to claim 1, comprising:

a lid configured to open and to close covering the carriage and the head unit; and a liquid supply unit coupled to the head unit and configured to supply liquid to the plurality of heads, wherein an engaging portion is provided inside the lid, the engaging portion being configured to engage with the liquid supply unit removed from the head unit when the lid is in an open state, and the liquid supplying unit is provided with an engaged portion configured to engage with the engaging portion.

11. A carriage on which a head unit is removably mounted from upstream in a discharge direction, the head unit including a support portion supporting a plurality of heads configured to discharge a droplet in the discharge direction, and at least one protruding portion protruding downstream in the discharge direction from a bottom surface of the support portion, the carriage comprising:

a bottom formed with an opening from which a nozzle surface of the head configured to discharge the droplet is exposed, wherein the bottom is provided with an insertion hole through which the at least one protruding portion is inserted, and a biasing member configured to bias the support portion in an intersecting direction intersecting with the discharge direction in a state where the at least one protruding portion is inserted through the insertion hole.

* * * * *